US010427013B2

(12) United States Patent
Boyd et al.

(10) Patent No.: US 10,427,013 B2
(45) **Date of Patent: *Oct. 1, 2019**

(54) GOLF CLUB HEAD OR OTHER BALL STRIKING DEVICE WITH FACE HAVING MODULUS VARIANCE

(71) Applicant: Karsten Manufacturing Corporation, Phoenix, AZ (US)

(72) Inventors: Robert Boyd, Double Oak, TX (US); Mark J. Perry, Hillard, OH (US); Jay R. Sayre, New Albany, OH (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/125,421

(22) Filed: Sep. 7, 2018

(65) Prior Publication Data

US 2019/0001199 A1 Jan. 3, 2019

Related U.S. Application Data

(63) Continuation of application No. 15/443,930, filed on Feb. 27, 2017, now Pat. No. 10,080,935, which is a continuation of application No. 14/535,955, filed on Nov. 7, 2014, now Pat. No. 9,579,548, which is a continuation of application No. 13/484,987, filed on May 31, 2012, now Pat. No. 8,882,609.

(51) Int. Cl.
*A63B 53/04* (2015.01)
*A63B 60/00* (2015.01)

(52) U.S. Cl.
CPC ..... *A63B 53/0466* (2013.01); *A63B 53/04* (2013.01); *A63B 53/047* (2013.01); *A63B 53/0475* (2013.01); *A63B 60/00* (2015.10); *A63B 53/0487* (2013.01); *A63B 2053/042* (2013.01); *A63B 2053/0416* (2013.01); *A63B 2053/0425* (2013.01); *A63B 2053/0429* (2013.01); *A63B 2053/0433* (2013.01); *A63B 2053/0462* (2013.01); *A63B 2209/00* (2013.01); *A63B 2209/023* (2013.01)

(58) Field of Classification Search
CPC ..... A63B 53/047; A63B 53/04; A63B 2053/0416; A63B 2053/042; A63B 2053/0425; A63B 2053/0429
USPC ..... 473/342, 345, 349, 350
See application file for complete search history.

(56) References Cited

U.S. PATENT DOCUMENTS 1,253,700 A 1/1918 McLaughlin
3,368,812 A 2/1968 Baldwin
(Continued)

FOREIGN PATENT DOCUMENTS

JP 406142239 5/1994

*Primary Examiner* — Benjamin Layno

(57) ABSTRACT

A ball striking device, such as a golf club head, includes a face having a ball striking surface, an inner surface opposite the ball striking surface, and a thickness defined between the ball striking surface and the inner surface, and a body connected to the face and extending rearward from the face. The face has a modulus gradient across the thickness of the face, such that the modulus of the face varies at different distances from the ball striking surface. The face may also include at least one of an insert, a composite material, a multi-layered structure, and/or a portion treated by a surface treatment to contribute to the modulus gradient.

16 Claims, 15 Drawing Sheets

(56) References Cited

U.S. PATENT DOCUMENTS 4,884,808 A 12/1989 Retzer
5,261,664 A 11/1993 Anderson
5,346,216 A 9/1994 Aizawa
5,362,047 A 11/1994 Shaw et al.
5,403,007 A 4/1995 Chen
5,407,202 A 4/1995 Igarashi
5,431,396 A 7/1995 Shieh
5,437,447 A 8/1995 Rigutto
5,505,453 A 4/1996 Mack
5,509,660 A 4/1996 Elmer
5,524,331 A 6/1996 Pond
5,921,871 A 7/1999 Fisher
6,042,486 A 3/2000 Gallagher
6,089,992 A * 7/2000 Onuki ..... A63B 53/04 473/324
6,203,443 B1 3/2001 Britton
6,224,496 B1 5/2001 Rowland et al.
6,227,986 B1 5/2001 Fisher
6,238,303 B1 5/2001 Fite
6,270,423 B1 8/2001 Webb
6,319,149 B1 11/2001 Lee
6,485,375 B1 11/2002 McKinley
6,641,487 B1 11/2003 Hamburger
6,672,975 B1 1/2004 Galloway
6,863,620 B2 3/2005 Tucker, Sr.
6,991,559 B2 1/2006 Yabu
7,101,290 B2 9/2006 Tucker, Sr.
7,108,611 B2 9/2006 MacIlraith
7,163,465 B2 1/2007 Edel
7,338,390 B2 3/2008 Lindsay
7,341,527 B1 3/2008 Fisher
7,413,517 B2 8/2008 Butler, Jr. et al.
7,416,494 B2 8/2008 Edel
7,431,662 B2 10/2008 Tucker, Sr. et al.
7,442,129 B2 10/2008 Bardha
7,448,959 B2 11/2008 Blankenship et al.
7,491,135 B1 2/2009 Rollinson
7,601,076 B2 10/2009 Rollinson
7,604,550 B1 10/2009 Currie
7,607,992 B2 10/2009 Nishio
7,666,108 B2 2/2010 Bryant et al.
7,691,006 B1 4/2010 Burke
7,815,519 B2 10/2010 Bryant et al.
7,878,919 B2 2/2011 Perry et al.
7,993,211 B2 8/2011 Bardha
8,033,931 B2 10/2011 Wahl et al.
8,157,668 B2 4/2012 Wahl et al.
8,177,663 B2 5/2012 Tucker et al.
8,187,116 B2 5/2012 Boyd et al.
8,353,780 B2 1/2013 Hatton et al.
8,376,873 B2 2/2013 Golden et al.
8,409,028 B2 4/2013 Wahl et al.
8,491,405 B2 7/2013 Jorgensen et al.
8,545,343 B2 10/2013 Boyd et al.
8,556,745 B2 10/2013 Currie
8,734,265 B2 5/2014 Soracco
8,740,719 B2 6/2014 Wahl et al.
8,753,228 B2 6/2014 Golden et al.
8,777,776 B2 7/2014 Wahl et al.
8,840,485 B2 9/2014 Jorgensen et al.
8,876,624 B2 11/2014 Ban et al.
8,882,609 B2 * 11/2014 Boyd ..... A63B 53/0466 473/342
9,526,952 B1 12/2016 Dacey et al.
2004/0009829 A1 1/2004 Kapilow
2004/0043832 A1 3/2004 Lee et al.
2004/0067800 A1 4/2004 Kawano
2007/0155529 A1 7/2007 Voges
2008/0004131 A1 1/2008 Lin et al.
2008/0102986 A1 5/2008 Lindsay
2008/0153619 A1 6/2008 Tucker et al.
2008/0194355 A1 8/2008 Liu
2009/0069908 A1 3/2009 Butler, Jr. et al.
2009/0111606 A1 4/2009 Bardha
2010/0113181 A1 5/2010 Lindsay et al.
2010/0261546 A1 10/2010 Nicodem
2011/0003649 A1 1/2011 Liu
2011/0028238 A1 2/2011 Boyd et al.
2012/0071258 A1 3/2012 Yamaguchi et al.
2013/0310192 A1 * 11/2013 Wahl ..... C25D 1/00 473/331

* cited by examiner

FIG. 10
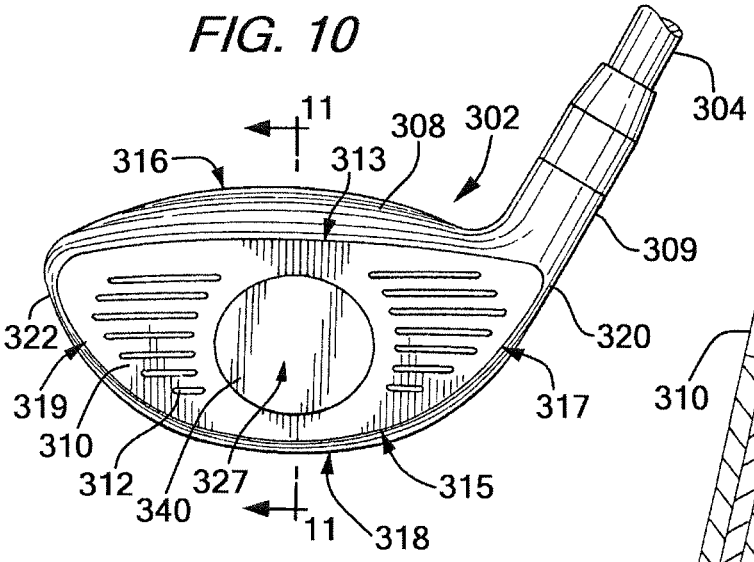
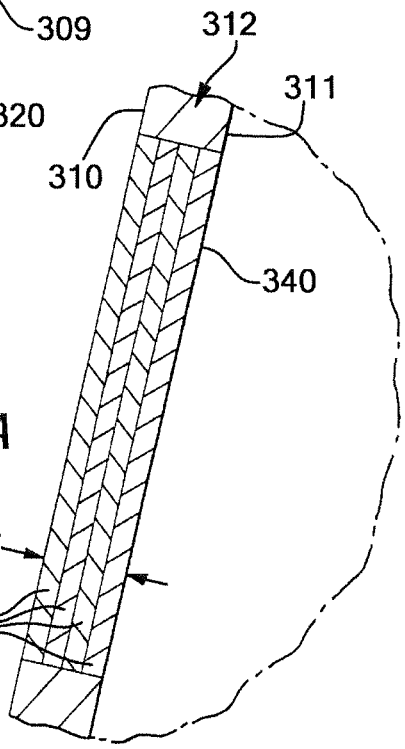
FIG. 11A
FIG. 11
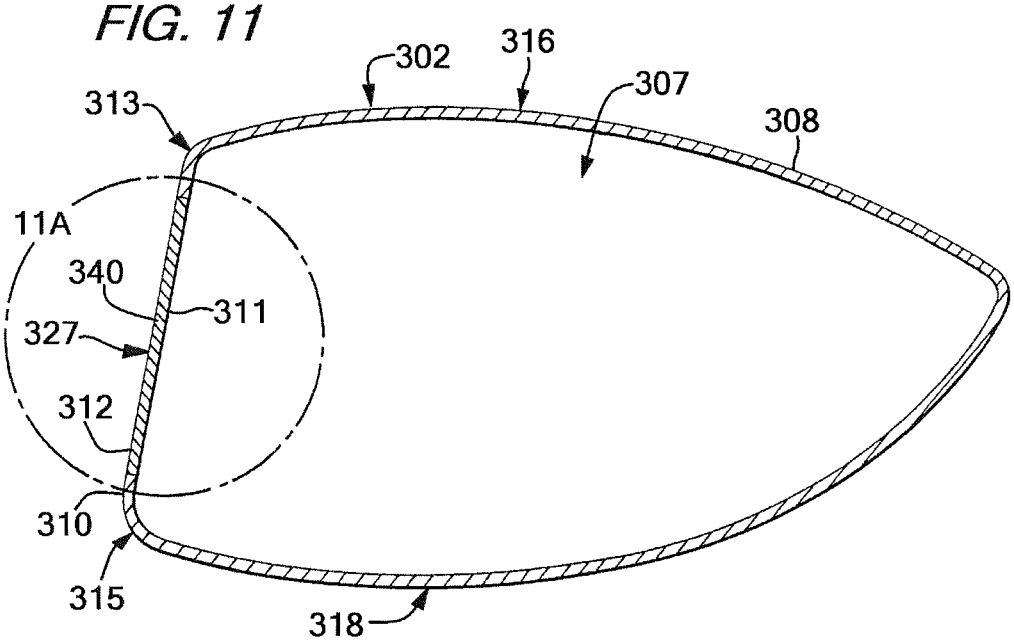

GOLF CLUB HEAD OR OTHER BALL STRIKING DEVICE WITH FACE HAVING MODULUS VARIANCE

CROSS-REFERENCE TO RELATED APPLICATION

This is a continuation of U.S. patent application Ser. No. 15/443,930, filed on Feb. 27, 2017, now U.S. Pat. No. 10,080,935, which is a continuation of U.S. patent application Ser. No. 14/535,955, filed on Nov. 7, 2014, and issued as U.S. Pat. No. 9,579,548, which is a continuation of U.S. patent application Ser. No. 13/484,987, filed on May 31, 2012, and issued as U.S. Pat. No. 8,882,609, which is hereby incorporated by reference in its entirety.

TECHNICAL FIELD

The invention relates generally to ball striking devices, such as golf clubs and heads. Certain aspects of this invention relate to golf clubs and golf club heads having a face that has a modulus that varies at different locations on the face.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club should meet the golf ball square (or substantially square) to the desired target path. Moreover, the golf club should meet the golf ball at or close to a desired location on the club head face (i.e., on or near a "desired" or "optimal" ball contact location) to reliably fly straight, in the desired direction, and for a desired distance. Off-center hits that deviate from squared contact and/or are located away from the club's desired ball contact location may tend to "twist" the club face when it contacts the ball, thereby sending the ball in the wrong direction, often imparting undesired hook or slice spin, and/or robbing the shot of distance. Thus, when the club face is not square at the point of engagement, the golf ball may fly in an unintended direction and/or may follow a route that curves left or right, ball flights that are often referred to as "pulls," "pushes," "draws," "fades," "hooks," or "slices," or may exhibit more boring or climbing trajectories.

The energy and velocity transferred to the ball by a golf club may be related, at least in part, to the flexibility of the club face at the point of contact, and can be expressed using a measurement called "coefficient of restitution" (or "COR"). The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at the center of the face. In one example, the area of highest response may have a COR that is equal to the prevailing USGA limit (e.g. 0.83), which may change over time. However, because golf clubs are typically designed to contact the ball at or around the center of the face, off-center hits may result in less energy being transferred to the ball, decreasing the distance of the shot. The COR at a specific location on the club head can be related to the modulus of elasticity at the impact location, as well as the modulus of other areas of the face spaced away from the impact location. Similarly, the contact time between the ball and the face during impact can affect energy transfer. Generally, a more flexible (lower modulus) face will produce higher contact times, resulting in greater energy transfer. The contact time is currently limited by the USGA at 257 μs, according to the USGA Characteristic Time (CT) test. Club head features that can increase the energy transferred to a ball during impact can be advantageous.

It is common for professional golfers and other experienced golfers to have higher swing speeds (i.e., the speed of the club head at or around impact with the ball) than less experienced golfers. Many club heads are designed to deliver optimal performance at higher swing speeds, and may offer less optimal performance at lower swing speeds. Accordingly, club head features that can improve performance at lower swing speeds can prove to be advantageous for use by less experienced golfers.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face having a ball striking surface configured for striking a ball and a body connected to the face and extending rearward from the face. The face also has an inner surface opposite the ball striking surface, and a thickness defined between the ball striking surface and the inner surface, and the face includes a multi-layered structure extending across the thickness of the face. The multi-layered structure includes at least a first layer having a first modulus and a second layer having a second modulus that is different from the first modulus. The multi-layered structure may be formed at least in part by an insert forming at least a portion of the face and extending across at least a portion of the thickness of the face, where the insert forms at least one of the first and second layers. The insert may include at least the first layer and the second layer in one embodiment.

According to one aspect, the insert may be located behind the ball striking surface. For example, the insert may be located within a recess on the ball striking surface, and the first layer is positioned between the insert and the inner surface. Alternately, the insert may form at least a portion of the ball striking surface.

According to another aspect, the insert may include a third layer of the multi-layered structure, such that the first layer and the second layer are positioned between the insert and one of the ball striking surface and the inner surface.

According to a further aspect, the insert may be formed of a composite material. For example, the composite material may be a layered composite material or a fiber-matrix composite material.

Additional aspects of the invention relate to a golf club head that includes a face having a ball striking surface, an inner surface opposite the ball striking surface, and a thickness defined between the ball striking surface and the inner surface, and a body connected to the face and extending rearward from the face. The face includes a multi-layered structure extending across the thickness of the face. The multi-layered structure includes a first layer having a first modulus and a second layer having a second modulus that is different from the first modulus, such that the multi-layered structure has a modulus gradient across the thickness of the face.

According to one aspect, the multi-layered structure may include at least a third layer, and the third layer may have a modulus that is different from the first modulus and the second modulus.

According to another aspect, the modulus of the face may be the highest or lowest at the ball striking surface or the inner surface. For example, the modulus of the first layer is the highest of the multi-layered structure, and the first layer may be positioned farthest from the ball striking surface. As another example, the modulus of the first layer is the highest of the multi-layered structure, and the first layer may form a portion of the ball striking surface. As a further example, the modulus of the first layer is the lowest of the multi-layered structure, and the first layer may be positioned farthest from the ball striking surface. As yet another example, the modulus of the first layer is the lowest of the multi-layered structure, and the first layer may form a portion of the ball striking surface.

Accordingly, in some embodiments, the modulus gradient may have a higher modulus at the ball striking surface than at an area behind the ball striking surface. In other embodiments, the modulus gradient may have a lower modulus at the ball striking surface than at an area behind the ball striking surface. In a further embodiment, the modulus gradient may have a higher modulus at the ball striking surface and at the inner surface than at an area located between the ball striking surface and the inner surface.

Further aspects of the invention relate to a wood-type golf club head that includes a face having a ball striking surface, an inner surface opposite the ball striking surface, and a thickness defined between the ball striking surface and the inner surface, and a wood-type body connected to the face and extending rearward from the face, with the body and the face defining an internal cavity behind the face. The face further includes a multi-layered structure extending across the thickness of the face. The multi-layered structure includes a first layer having a first modulus, a second layer having a second modulus, and a third layer having a third modulus, where at least one of the second modulus and the third modulus is different from the first modulus, such that the multi-layered structure has a modulus gradient across the thickness of the face. The first modulus, the second modulus, and the third modulus may all be different in some embodiments.

According to one aspect, the multi-layered structure further includes a fourth layer having a fourth modulus, where at least one of the second modulus, the third modulus, and the fourth modulus is different from the first modulus. In one embodiment, the first, second, third, and fourth layers are layered in respective order, with the first layer forming at least a portion of the ball striking surface and the fourth layer forming at least a portion of the inner surface, and the relative moduli of the layers may vary. In this embodiment, the first modulus may be the highest of the multi-layered structure in one example, and the fourth modulus is the highest of the multi-layered structure in another example. In a further example, the first modulus and the fourth modulus may be higher than the second modulus and the third modulus.

Still further aspects of the invention relate to a golf club head that includes a face having a ball striking surface, an inner surface opposite the ball striking surface, and a thickness defined between the ball striking surface and the inner surface, and a body connected to the face and extending rearward from the face. The face has a modulus gradient across the thickness of the face, such that the modulus of the face varies at different distances from the ball striking surface.

According to one aspect, the modulus at the ball striking surface may be higher than the modulus of the face at a point spaced inwardly from the ball striking surface. For example, the modulus of the face may be greatest at the ball striking surface. As another example, the modulus of the face at the ball striking surface and the modulus of the face at the inner surface may be higher than the modulus of the face at any point between the ball striking surface and the inner surface. Alternately, the modulus of the face may be greatest at the inner surface.

According to another aspect, the face has a multi-layered structure formed of at least two layers of different materials having different moduli to form the modulus gradient.

According to a further aspect, the modulus gradient of the face may have a stepped gradient configuration or a smooth gradient configuration.

According to yet another aspect, at least one of the ball striking surface and the inner surface of the face has a surface treatment changing the modulus of the areas of the face proximate the surface treatment.

Other aspects of the invention relate to a golf club head that includes a face having a ball striking surface and an inner surface opposite the ball striking surface, and a body connected to the face and extending rearward from the face.

At least one of the ball striking surface and the inner surface of the face is treated by a surface treatment increasing a modulus of the face at the treated surface(s), such that the modulus of the face at the ball striking surface and/or the inner surface is higher than the modulus of the face at a point located between the inner surface and the ball striking surface. In one embodiment, both the ball striking surface and the inner surface are treated by the surface treatment.

According to one aspect, the surface treatment includes at least one technique selected from a group consisting of: carburizing or other case hardening technique, plasma etching, peening, electron-beam surface treatment, laser surface hardening, flame hardening, induction hardening, diffusion hardening, nitriding, quenching, precipitation strengthening, surface oxygen diffusion permeation, coating, etc.

According to another aspect, the modulus of the face may be highest at the surface treated by the surface treatment. For example, when the ball striking surface is treated by the surface treatment, the modulus of the face may be highest at the ball striking surface. As another example, when the inner surface is treated by the surface treatment, the modulus of the face may be the highest at the inner surface.

According to a further aspect, the surface treatment increases the modulus of the face at a depth of 0.004 inches to 0.080 inches from the treated surface(s).

Other aspects of the invention relate to a golf club head including a face having a ball striking surface and an inner surface opposite the ball striking surface, and a body connected to the face and extending rearward from the face. At least a portion of the face may be formed of a composite material. In one embodiment, at least a portion of the face is formed of a composite material that includes a polymer matrix and a reinforcing material having a modulus that is higher than the modulus of the polymer matrix. In this embodiment, the modulus of the reinforcing material may be one or more orders of magnitude higher than the modulus of the polymer matrix. In another embodiment, at least a portion of the face is formed of a layered composite material that includes a first material having a first modulus layered in a plurality of layers with a second material having a second modulus that is higher than the first modulus. In this embodiment, the second modulus may be at least two times higher than the first modulus.

According to one aspect, the face may include an insert formed of the composite material.

According to another aspect, the composite material may form a portion of at least one of the ball striking surface and the outer surface of the face.

Other aspects of the invention relate to a method that includes providing a golf club head as described above, and connecting an insert to the face, as described above.

Still other aspects of the invention relate to golf clubs that include a golf club head as described above and a shaft connected to the head, or a set of golf clubs including at least one golf club having a head as described above.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which:

FIG. 10 is a front view of another illustrative embodiment of a wood-type golf club head according to aspects of the present invention, that may be utilized with the ball striking device of FIG. 1;

FIG. 11 is a cross-section view of the head of FIG. 10, taken along lines 11-11 of FIG. 10;

FIG. 11A is a magnified cross-section view of a portion of the head as shown in FIG. 11, identified by marked area 11A in FIG. 11;

Figure 1:
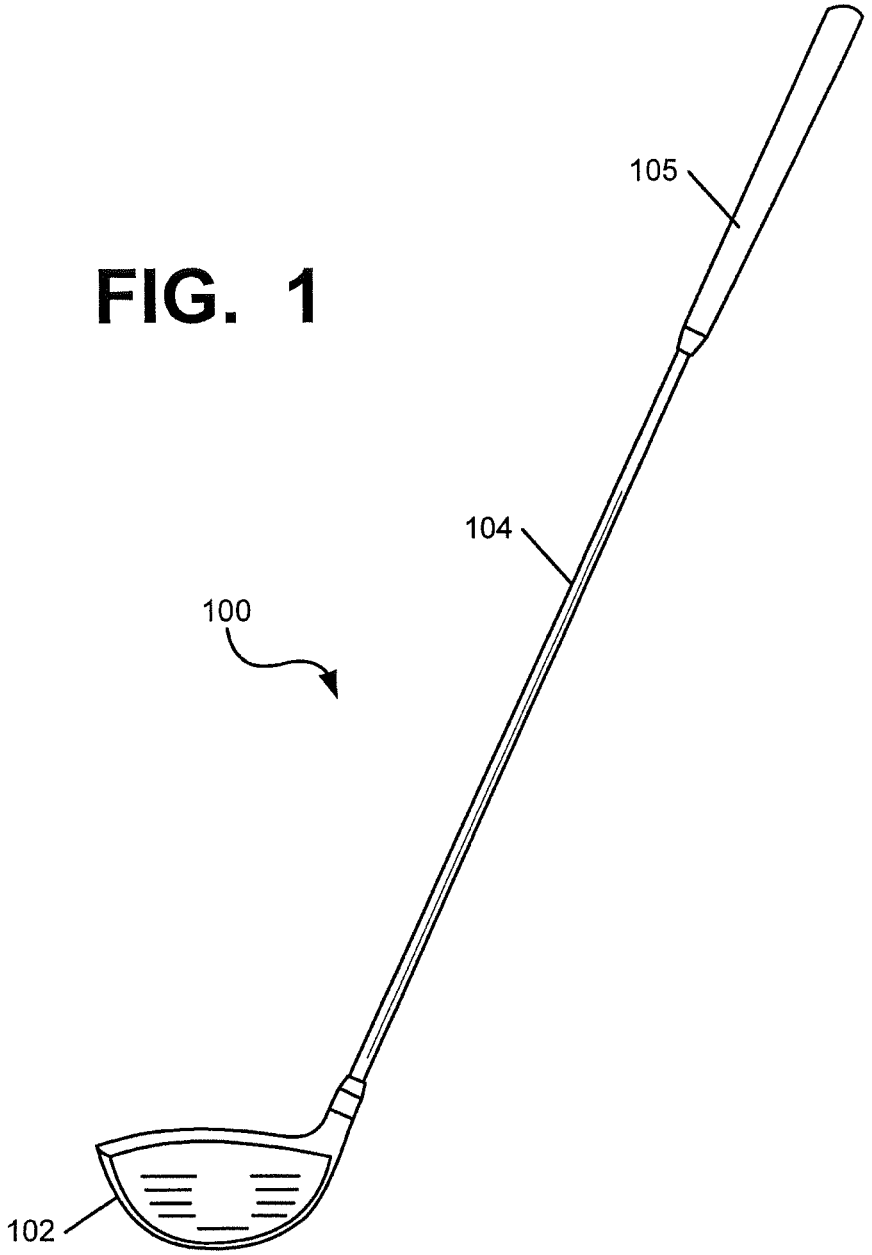
FIG. 1 is a front view of an illustrative embodiment of a wood-type ball striking device according to aspects of the present invention.
Figure 2:
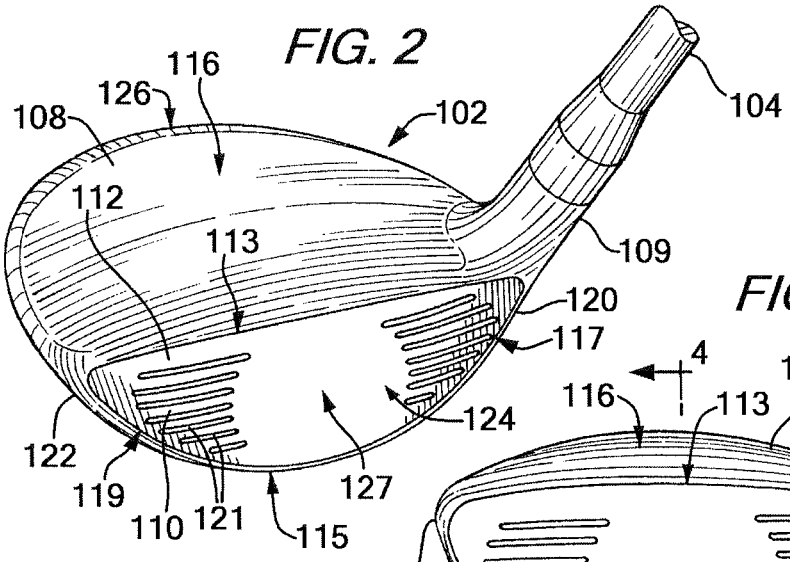
FIG. 2 is a perspective view of a head of the ball striking device of FIG. 1.
Figure 3:
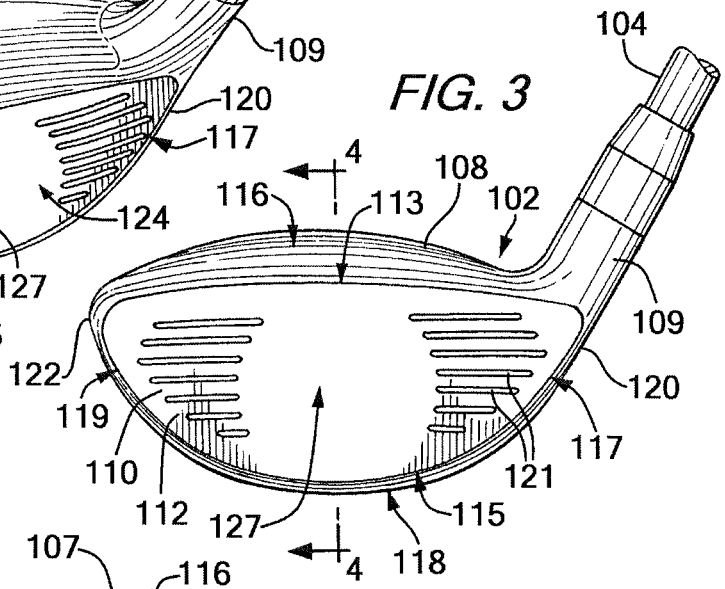
FIG. 3 is a front view of the head of FIG. 2.

It is understood that the relative sizes and thicknesses of the components shown in the magnified views, including FIGS. 4A, 4B, 5A, 6A, 7, 8, 11A, and 12A may be distorted in order to show relevant detail.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, and welding (including brazing, soldering, or the like), where separation of the joined pieces cannot be accomplished without structural damage thereto.

"Modulus" means the elastic modulus of a material, specifically Young's modulus, which can be determined using standardized testing procedures.

In general, aspects of this invention relate to ball striking devices, such as golf club heads, golf clubs, and the like. Such ball striking devices, according to at least some examples of the invention, may include a ball striking head and a ball striking surface. In the case of a golf club, the ball striking surface is a substantially flat surface on one face of the ball striking head. It is understood that some golf clubs or other ball striking devices may have more than one ball striking surface. Some more specific aspects of this invention relate to wood-type golf clubs and golf club heads. Alternately, some aspects of this invention may be practiced with iron-type golf clubs and golf club heads, hybrid clubs, chippers, putters, etc.

According to various aspects of this invention, the ball striking device may be formed of one or more of a variety of materials, such as metals (including metal alloys), ceramics, polymers, elastomers, composites (including fiber-reinforced composites or nano- and micro-particle reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other composites. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, filament winding, compression molding, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to the invention relate to golf club head structures, including heads for wood-type golf clubs, such as drivers, fairway woods, etc. Other examples of ball striking devices according to the invention may relate to iron-type golf clubs, such as long iron clubs (e.g., driving irons, zero irons through five irons), short iron clubs (e.g., six irons through pitching wedges, as well as sand wedges, lob wedges, gap wedges, and/or other wedges), as well as hybrid clubs, putters, chippers, and other types of clubs. Such devices may include a one-piece construction or a multiple-piece construction. Example structures of ball striking devices according to this invention will be described in detail below in conjunction with FIG. 1, which illustrates an example of a ball striking device 100 in the form of a golf driver, and FIG. 16, which illustrates an example of a ball striking device 600 in the form of an iron-type golf club, in accordance with at least some examples of this invention.

FIGS. 1-4 illustrate a ball striking device 100 in the form of a golf driver, in accordance with at least some examples of the invention, and FIGS. 4A-15 and 21-28 illustrate various additional embodiments of a golf driver in accordance with aspects of the invention. As shown in FIG. 1, the ball striking device 100 includes a ball striking head 102 and a shaft 104 connected to the ball striking head 102 and extending therefrom. The ball striking head 102 of the ball striking device 100 of FIG. 1 has a face 112 connected to a body 108, with a hosel 109 extending therefrom. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. In the club 100 shown in FIG. 1, the head 102 has a relatively large volume, as the club 100 is designed for use as a driver, intended to hit the ball 106 (shown in FIGS. 4-5) accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. If instead configured as a fairway wood, the head may have a volume of 120 cc to 230 cc, and if configured as a hybrid club, the head may have a volume of 85 cc to 140 cc. Other appropriate sizes for other club heads may be readily determined by those skilled in the art.

In the illustrative embodiment illustrated in FIGS. 1-4, the head 102 has a hollow structure defining an inner cavity 107 (e.g., defined by the face 112 and the body 108). Thus, the head 102 has a plurality of inner surfaces defined therein. In one embodiment, the hollow inner cavity 107 may be filled with air. However, in other embodiments, the head 102 could be filled with another material, such as foam. In still further embodiments, the solid materials of the head may occupy a greater proportion of the volume, and the head may have a smaller cavity or no inner cavity at all. It is understood that the inner cavity 107 may not be completely enclosed in some embodiments. In the embodiment illustrated in FIGS. 1-4, the body 108 of the head 102 has a squared or rectangular rear profile. In other embodiments, the body 108 of the head 102 can have another shape or profile, including a rounded shape or other any of a variety of other shapes. In still further embodiments, the cavity may be evacuated under negative pressure. It is understood that such shapes may be configured to distribute weight away from the face 112 and/or the geometric/volumetric center of the head 102, in order to create a lower center of gravity and/or a higher moment of inertia. The body 108 may be connected to a hosel 109 for connection to a shaft 104, as described below.

Figure 4:
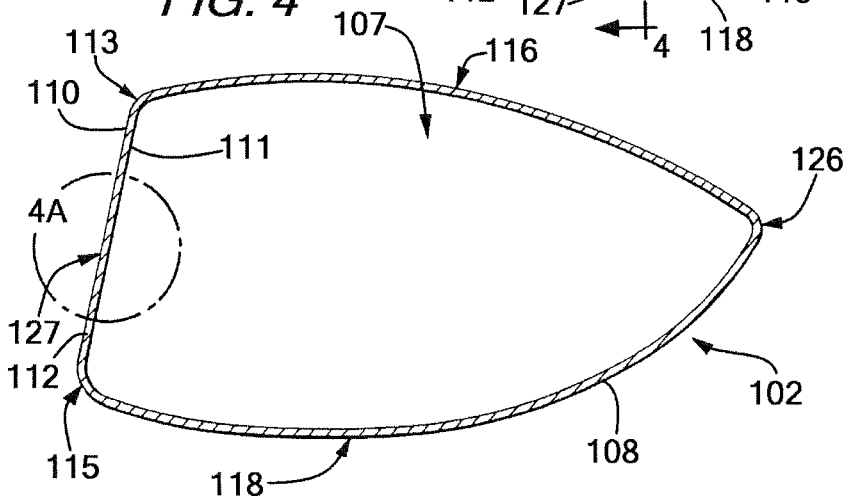
FIG. 4 is a cross-section view of the head of FIG. 2, taken along lines 4-4 of FIG. 3.

The face 112 is located at the front 124 of the head 102, and has a ball striking surface 110 located thereon and an inner surface 111 opposite the ball striking surface 110, with a thickness T defined between the inner surface 111 and the ball striking surface 110 (shown in FIG. 4). The ball striking surface 110 is typically an outer surface of the face 112 configured to face a ball 106 in use, and is adapted to strike the ball when the device 100 is set in motion, such as by swinging. The face 112 is defined by a plurality of peripheral edges, including a top edge 113, a bottom edge 115, a heel edge 117, and a toe edge 119. Additionally, in this embodiment, the face 112 has a plurality of face grooves 121 on the ball striking surface 110, which do not extend across the hot zone at the center of the face 112. In another embodiment, such as a fairway wood head a hybrid wood-type head, the face 112 may have grooves 121 that extend across at least a portion of the hot zone of the face 112.

As shown, the ball striking surface 110 is relatively flat, occupying most of the face 112. For reference purposes, the portion of the face 112 nearest the top face edge 113 and the heel 120 of the head 102 is referred to as the "high-heel area" the portion of the face 112 nearest the top face edge 113 and toe 122 of the head 102 is referred to as the "high-toe area"; the portion of the face 112 nearest the bottom face edge 115 and heel 120 of the head 102 is referred to as the "low-heel area"; and the portion of the face 112 nearest the bottom face edge 115 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIG. 1, the ball striking surface 110 is inclined slightly (i.e., at a loft angle), to give the ball 106 slight lift and spin when struck. In other illustrative embodiments, the ball striking surface 110 may have a different incline or loft angle, to affect the trajectory of the ball 106. Additionally, the face 112 may have a variable thickness and/or may have one or more internal or external inserts in some embodiments.

It is understood that the face 112, the body 108, and/or the hosel 109 can be formed as a single piece or as separate pieces that are joined together. For example, in one embodiment, face 112 may be formed as part of a face member 128 with the body 108 being partially or wholly formed by one or more separate pieces connected to the face member 128, such as in the embodiments illustrated in FIGS. 21-27. For example, the face member 128 may have a wall or walls 125 extending rearward from the edges of the face 112, such as in the configurations illustrated in FIGS. 24 and 25, which is also known as a "cup face" structure. Additionally, at least a portion of the body 108 may be formed as a separate piece or pieces joined to the wall(s) of the face member, such as by a body member 129 attached to the cup face structure, composed of a single piece or multiple pieces, as also shown in FIGS. 21-27. These pieces may be connected by an integral joining technique, such as welding, cementing, or adhesively joining. Other known techniques for joining these parts can be used as well, including many mechanical joining techniques, including fasteners and other releasable mechanical engagement techniques. FIGS. 21-28 illustrate various configurations for joining the face 112 and the body 108, and are described in greater detail below. If desired, the hosel 109 may be integrally formed as part of the face member 128. Further, a gasket (not shown) may be included between the face member and the body member.

The ball striking device 100 may include a shaft 104 connected to or otherwise engaged with the ball striking head 102, as shown in FIG. 1. The shaft 104 is adapted to be gripped by a user to swing the ball striking device 100 to strike the ball 106. The shaft 104 can be formed as a separate piece connected to the head 102, such as by connecting to the hosel 109, as shown in FIG. 1. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention.

The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 105 may be positioned on the shaft 104 to provide a golfer with a slip resistant surface with which to grasp golf club shaft 104, as shown in FIG. 1. The grip element 105 may be attached to the shaft 104 in any desired manner, including in conventional manners known and used in the art (e.g., via adhesives or cements, threads or other mechanical connectors, swedging/swaging, etc.).

In general, FIGS. 1-4 illustrate a head 102 where at least a portion of the face 112 has a modulus gradient across the thickness T of the face 112, such that the modulus of the face 112 varies across the thickness of the face 112, or in other words, the elastic modulus of the material is different at different distances from the ball striking surface 110 along at least one virtual line extending from the ball striking surface 110 to the inner surface 111. In one embodiment, the entire face 112 or substantially the entire face 112 has a modulus gradient across the thickness T of the face 112. In another embodiment, only a portion of the face 112 has a modulus gradient across the thickness of the face 112. The portion of the face 112 may be located at or around the area of highest response 127 of the face 112, or other area of the face 112 that is expected to have the most frequent impacts with the ball 106, and may make up a majority of the face 112. It is understood that the area of the face 112 that is expected to have the most frequent impacts may be another location on the face 112, such as if a golfer has a particular hitting pattern.

In one embodiment, the modulus gradient may be such that the modulus of the face 112 is greatest at the ball striking surface 110. It is understood that the portions having a high modulus may extend for a certain depth behind the ball striking surface 110, such as 0.004 inches to 0.120 inches (0.1 to 3.0 mm), and that the modulus gradient may be present on a portion or the entire face 112. For example, the modulus may decrease from the ball striking surface 110 to the inner surface 111, such that the modulus is lowest at the inner surface 111. As another example, the modulus may be higher at the ball striking surface 110 and then relatively constant through the rest of the thickness of the face 112. The embodiment of FIG. 7 (described below), which includes a surface treatment, may have a high modulus at the ball striking surface 210A and a relatively constant modulus through the rest of the thickness of the face 212A. As a further example, the modulus may vary in different ways at different locations behind the ball striking surface 110.

In another embodiment, the modulus gradient may be such that the modulus of the face 112 is greatest at the inner surface 111. It is understood that the high modulus may extend for a certain depth in front of the inner surface 111, such as 0.004 inches to 0.120 inches (0.1 to 3.0 mm), and that the modulus gradient may be present on a portion or the entire face 112. For example, the modulus may decrease from the inner surface 111 to the ball striking surface 110, such that the modulus is lowest at the inner surface 111. As another example, the modulus may be higher at the inner surface 111 and then relatively constant through the rest of the thickness of the face 112. The embodiment of FIG. 8 (described below), which includes a surface treatment on the inner surface 211B, may have a high modulus at the inner surface 211B and a relatively constant modulus through the rest of the thickness of the face 212B. As a further example, the modulus may vary in different ways at different locations in front of the inner surface 111.

In another embodiment, the modulus of the face 112 at the ball striking surface 110 and the modulus of the face 112 at the inner surface 111 are higher than the modulus of the face 112 at any point between the ball striking surface 110 and the inner surface 111. In other words, the face 112 may be stiffer at the ball striking surface 110 and the inner surface 111, with a softer material sandwiched between. Again, it is understood that the high modulus may extend for a certain depth in front of the inner surface 111 and/or behind the ball striking surface 110, such as 0.004 inches to 0.120 inches (0.1 to 3.0 mm), and that the modulus gradient may be present on a portion or the entire face 112. The modulus may vary in different ways between the ball striking surface 110 and the inner surface 111. Alternately, the face 112 may be more flexible at the ball striking surface 110 and the inner surface, with a stiffer material sandwiched between. For example, the face 112 may include a stiff composite material that is coated on one or both surfaces by a more flexible metallic material.

Figure 7:
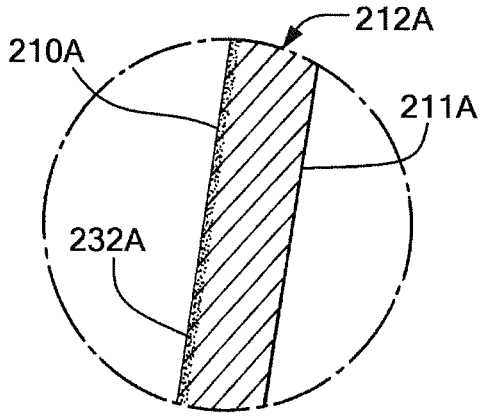
FIG. 7 is a magnified cross-section view of a portion of another illustrative embodiment of a wood-type golf club head according to aspects of the present invention, that may be utilized in connection with the ball striking device of FIG. 1.
Figure 8:
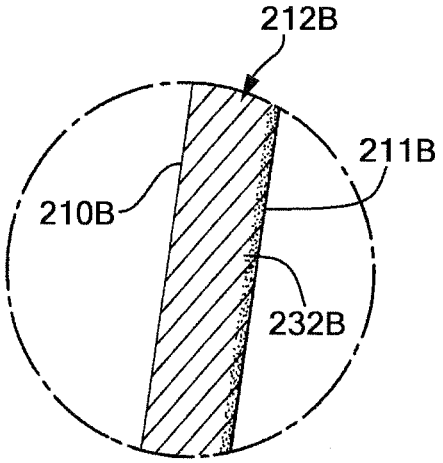
FIG. 8 is a magnified cross-section view of a portion of another illustrative embodiment of a wood-type golf club head according to aspects of the present invention, that may be utilized in connection with the ball striking device of FIG. 1.

In various embodiments, the modulus gradient of the face may have a stepped gradient configuration, a smooth gradient configuration, or another variable modulus configuration, including a combination of smooth and stepped configurations. In a stepped gradient configuration, the modulus gradient through the thickness T of the face 112 may be composed of several varying "steps" of relatively constant modulus. Such a configuration may be created, for example, by a plurality of layers having varying moduli, as shown in FIGS. 4-6A and 10-15 and described below. In a smooth gradient configuration, the modulus gradient may change steadily and incrementally through the thickness of the face 112. Such a configuration may be created, for example, by a material with one or more surface treatments to change the modulus, as shown in FIGS. 4B, 7, and 8 and described below. In other examples, different structures may be used to create a smooth, stepped, or other modulus gradient configuration.

Figure 4A:
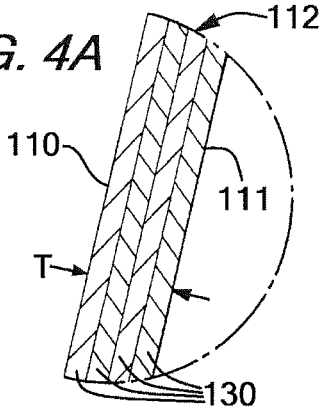
FIG. 4A is a magnified cross-section view of a portion of the head as shown in FIG. 4, identified by marked area 4A in FIG. 4.
Figure 4B:
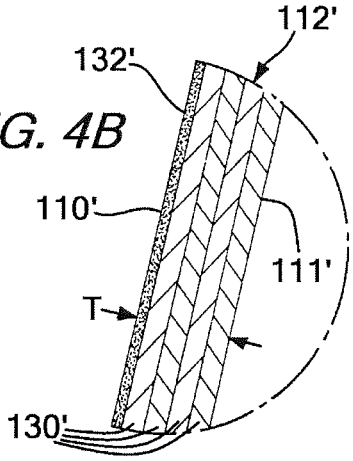
FIG. 4B is a magnified cross-section view of a portion of another illustrative embodiment of a wood-type golf club head according to aspects of the present invention, that may be utilized in connection with the ball striking device of FIG. 1.

As shown in FIG. 4A, in one embodiment, the head 102 of FIGS. 1-4 has a face with a multi-layered structure that creates a modulus gradient across the thickness T of at least a portion of the face 112. In general, the multi-layered structure in FIG. 4A includes a plurality of layers 130, with at least one of the layers 130 having a different modulus than at least one of the other layers. In this embodiment, the face 112 has four layers 130, but in other embodiments, the face 112 may have a different multi-layered structure with a different number of layers 130. The moduli of these layers 130 may be such that any of the example embodiments of modulus gradients described above may be achieved. For example, the multi-layered structure may have a stiffer (i.e. higher modulus) layer 130 at the ball striking surface 110 and a stiffer layer 130 at the inner surface, with the other layers 130 having lower moduli. In another example, the layer 130 at the ball striking surface 110 may have the lowest modulus with the layers 130 each having a modulus that increases to a maximum at the layer 130 at the inner surface 130. In another example, the multi-layered structure may have the opposite configuration, with the moduli of the layers 130 increasing from the inner surface 111 to a maximum at the ball striking surface 110. Various other modulus gradients can be achieved by this structure or another multi-layered structure, including any other examples described herein.

In the embodiment shown in FIG. 4A, the entire face 112 is formed of the multi-layered structure, extending to the top, bottom, heel, and toe edges 113, 115, 117, 119 of the face 112. In another embodiment, only a portion of the face 112 may have the multi-layered structure. For example, the multi-layered portion of the face 112 may be positioned around the area of highest response 127 or another location on the face 112 as described above. In one example, the multi-layered portion of the face 112 may be formed by an insert having one or more layers, as shown in FIGS. 7-14 and described below.

A variety of different materials and combinations of materials may be used to construct the face 112 and/or portions of the face 112, such as inserts as described below. Such materials may include metals such as titanium, aluminum, steels (including stainless steels), and other metals, including alloys thereof. Many metals can be treated by one or more surface treatments to change the modulus of the surface, such as carburizing or case-hardening a steel alloy. Additionally, various metals having different moduli can be layered with each other to create a multi-layered structure as described herein. A metal foam with a density gradient that changes based on the distance from the surface (such as an integral skin foam) may be used to create a modulus gradient on the face 112. Additionally, one or more polymer materials may be used in connection with the face 112, to produce various modulus effects, including materials such as elastomers or foams.

Materials used in the face 112 may also include composite materials, including a reinforcement-matrix composite, such as fiber-matrix composites including fiberglass, basalt, ultra-high molecular weight polyolefin, carbon-fiber composites, etc., as well as layered composites and other types of composites. Typically, a reinforcement-matrix composite includes at least one reinforcing material (such as a fiber material) and at least one matrix material, which may be a polymer material, where the matrix material has a different (often lower) modulus than the reinforcing material. In one embodiment, the modulus of the reinforcing material may be at least two times higher than the modulus of the matrix material. In another embodiment, the modulus of the reinforcing material may be at least an order of magnitude (i.e. 10$x$) higher than the modulus of the matrix material. Such composites can be used to create a face 112 having a modulus gradient, where the stiffer reinforcing material dominates the response at lower impact speeds and the more flexible matrix material contributes more at higher impact speeds. A layered or laminate composite may contain a plurality of alternating layers of materials having different moduli, such as a titanium-carbon fiber composite layered structure (e.g. TiGr) or an aluminum-fiberglass composite layered structure (e.g. GLARE). Such composites can also be used to create a face 112 having a modulus gradient, where the stiffer material dominates the response at lower impact speeds and the more flexible material (typically the metal) contributes more at higher impact speeds. Other composite materials may be used to achieve similar effects.

In another embodiment, the face 112 of FIG. 4A can be treated with a surface treatment that changes the modulus of the treated surface at or around the area of the surface treatment. FIG. 4B illustrates a face 112' with the multi-layered structure of FIG. 4A, having a surface treatment on the ball striking surface 110', with an affected area 132' that has a modulus that is changed by the surface treatment. The surface treatment may include one or more different techniques that can change the modulus of the surface, such as carburizing or other case hardening technique, plasma etching, peening, electron-beam surface treatment, laser surface hardening, flame hardening, induction hardening, diffusion hardening, nitriding, quenching, precipitation strengthening, surface oxygen diffusion permeation, coating, etc. Some surface treatments may be applied to raise the modulus of the treated surface. For example, the ball striking surface 110' may be treated to raise the modulus of the surface, and may create a configuration where the modulus of the face 112' is highest at the ball striking surface 110'. In another embodiment, the ball striking surface 110' may be treated to lower the modulus of the surface, and may create a configuration where the modulus of the face 112' is lowest at the ball striking surface 110'. In other embodiments, the inner surface 111' of the face 112' can be treated by a surface treatment to raise or lower the modulus of the surface, in addition to or instead of the ball striking surface 110'. These surface treatments may create configurations where the inner surface 111' has the highest or lowest modulus of the face 112', as described above. It is understood that the modulus change due to the surface treatment may extend a certain depth into the respective surface, as shown in FIG. 4B, where the affected area 132' of the face 112' is shown having a depth. The depth of the affected area 132' may be from 0.004 inches to 0.080 inches in one embodiment. In the embodiment shown in FIG. 4B, the affected area 132' of the surface treatment covers the entire ball striking surface 110'. In another embodiment, only a portion of the face 112' may be treated, and the affected area 132' may occupy less than the entire surface 110', 111'. For example, the face 112' may include an insert that is treated by a surface treatment.

The modulus gradient of the face 112 can influence the impact of a ball 106 on the face 112 in different ways, depending on the type and degree of the modulus gradient. The modulus gradient as described herein may also produce a variable response of the face 112 depending on the swing speed or impact speed of the head 102 with the ball 106. In other words, the modulus gradient may produce a configuration where the face 112 produces a response and/or contact time at one range of swing speeds and a different response and/or contact time at a different range of swing speeds. This effect can depend on how much each of the different portions of the face 112 (having different moduli) contribute to the response during an impact, which may in turn depend on the depth of such portions of the face 112 from the ball striking surface 110. Several examples of different configurations having variable responses at different swing speeds are described below, first with reference to the multi-layered structure of FIGS. 5-6A.

Figure 5:
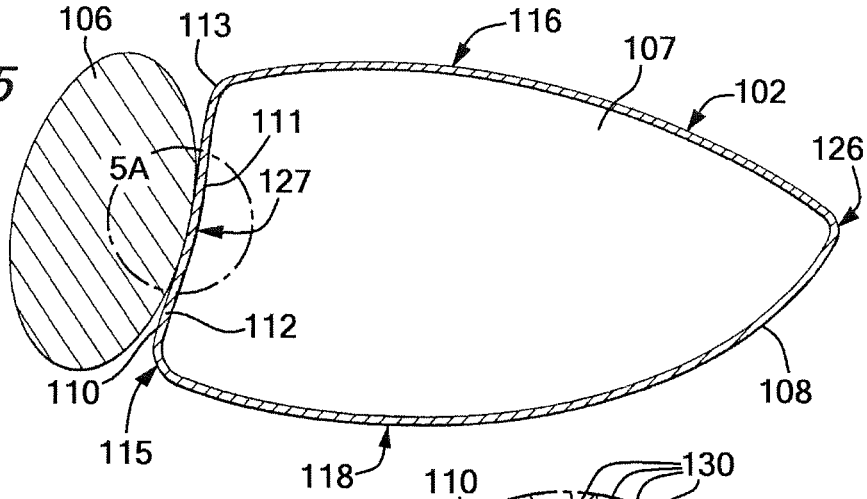
FIG. 5 is a cross-section view of the head as shown in FIG. 4, illustrated during a high-speed impact with a ball.
Figure 5A:
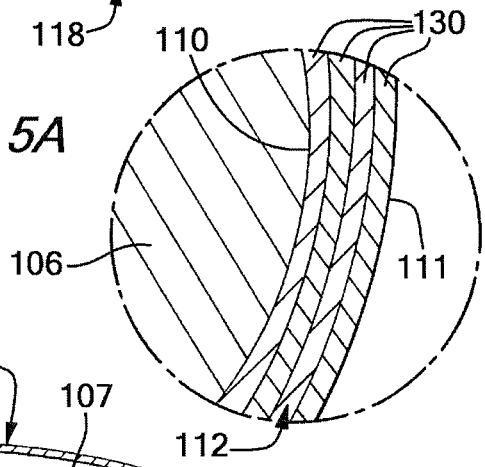
FIG. 5A is a magnified cross-section view of a portion of the head as shown in FIG. 5, identified by marked area 5A in FIG. 5.
Figure 6:
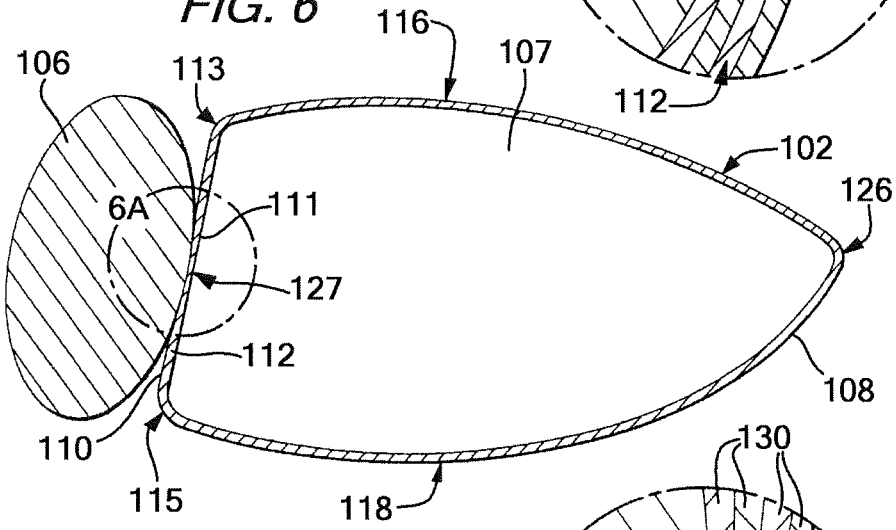
FIG. 6 is a cross-section view of the head as shown in FIG. 4, illustrated during a low-speed impact with a ball.
Figure 6A:
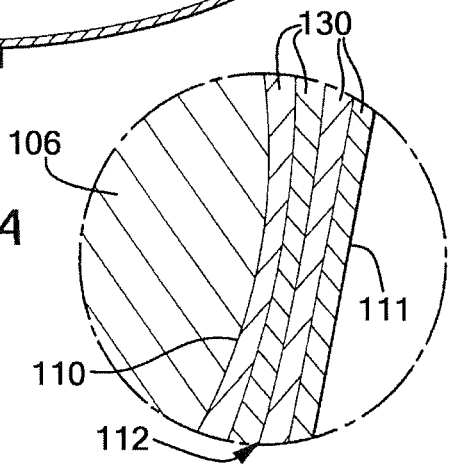
FIG. 6A is a magnified cross-section view of a portion of the head as shown in FIG. 6, identified by marked area 6A in FIG. 6.

FIGS. 5-6A illustrate impacts between a face 112 with the configuration of FIG. 4A and a golf ball 106. As shown in FIGS. 5 and 5A, an impact with a ball 106 at high speed (e.g. 160 ft/s in one embodiment, and 180 ft/s in another embodiment) may produce significant deflection in all four layers 130 of the multi-layered structure. Accordingly, in some embodiments, at higher impact speeds, the moduli of all of the layers 130 have significant influence on the response and contact time of the impact. As shown in FIGS. 6 and 6A, an impact with a ball 106 at lower speeds (e.g. 80 ft/s or more) may deflect the layers 130 closer to the ball striking surface 110 to a significant degree, and may deflect the deeper layers 130 closer to the inner surface 111 to a lesser degree. Accordingly, in some embodiments, at a lower impact speeds, the moduli of the layers 130 closer to the ball striking surface 110 may have significantly more influence on the response and contact time of the impact as compared to the deeper layers 130 closer to the inner surface 111. It is understood that similar effects may be experienced in a non-layered structure as well. This effect can be increased or lessened by the use of different modulus gradients in the face 112.

For example, the face 112 can have a modulus gradient such that the ball striking surface 110 is stiffer than the material behind the ball striking surface 110. This can allow the face 112 to conform to CT test standards, which engage the areas of the face 112 at a smaller depth from the ball striking surface 110 to a greater degree, while providing greater contact times during ball impact, when deeper, more flexible portions of the face 112 are significantly engaged and flexed. In this example, the face 112 may also have increased modulus at the inner surface 111, with more flexible material between the inner surface 111 and the ball striking surface 110, to provide added stiffness at higher speed impacts. As another example, the face 112 can have more flexible material near the ball striking surface 110, to provide more flexibility and greater contact time for impacts, particularly at lower speeds, while having a stiffer material at the inner surface 111 to provide stiffness to prevent excessive deflection, such as during higher speed impacts. A variety of other modulus gradients can produce different impact effects at a range of different swing speeds. It is understood that these effects can be produced by multi-layered or non-layered structures with modulus gradients as described herein (including smooth, stepped, or other modulus gradients), which may also include one or more surface treatments.

Figure 9:
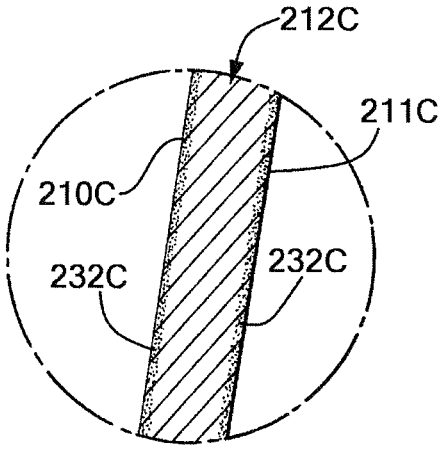
FIG. 9 is a magnified cross-section view of a portion of another illustrative embodiment of a wood-type golf club head according to aspects of the present invention, that may be utilized in connection with the ball striking device of FIG. 1.

FIGS. 7-9 illustrate non-layered faces 212A-C that have surface treatments as discussed above with respect to FIG. 4B. The face 212A illustrated in FIG. 7 has a ball striking surface 210A and an inner surface 211A, with a surface treatment on the ball striking surface 210A, creating an affected area 232A that occupies at least a portion of the ball striking surface 210A. The face 212B illustrated in FIG. 8 has a ball striking surface 210B and an inner surface 211B, with a surface treatment on the inner surface 211B, creating an affected area 232B that occupies at least a portion of the inner surface 211B. The face 212C illustrated in FIG. 9 has a ball striking surface 210C and an inner surface 211C, with surface treatments on the ball striking surface 210C and the inner surface 211C, creating affected areas 232C that occupy at least a portion of the ball striking surface 210C and at least a portion of the inner surface 211C. As described above with respect to FIG. 4B, the surface treatments of FIGS. 7-9 may be applied to all or a portion of the respective surfaces of the face 212A-C creating an affected area 232A-C that covers at least a portion of the face 212A-C. It is understood that the modulus change due to the surface treatment may extend a certain depth into the respective surfaces, as shown in FIGS. 7-9, where the affected areas 232A-C of the faces 232A-C are each shown having a depth. The depth of the affected areas 232A-C may be from 0.004 inches to 0.080 inches in one embodiment. Such surface treatments on the face 212A-C can be used to create a variety of different modulus gradients, including the modulus gradients described above. As described above, the surface treatment(s) can be used to raise or lower the modulus of the affected surface. As one example, a surface treatment can be performed on a surface of the face 212A-C to harden the surface and/or raise the modulus of the surface. As another example, a surface treatment can be performed on a surface of the face 212A-C to lower the modulus of the surface. In one such embodiment, the face 212A-C can be made by coating one or both surfaces of a stiff composite material with a thin coat of more flexible metallic material. Additionally, as described above, the portions of the faces 212A-C shown in FIGS. 7-9 may be portions of an insert that is treated by a surface treatment, such as the inserts 340, 440, 540, 640 shown in FIGS. 10-15 and described below.

As mentioned above, in some embodiments, the face 112 may include at least one insert that at least partially creates the modulus gradient, and may include multiple inserts in some embodiments. FIGS. 10-11A illustrate one example of a head 302 with a face 312 that includes an insert 340 that at least partially creates a modulus gradient for the face 312. Many features of the head 302 of FIGS. 10-11A are similar to the features of the head 102 shown in FIGS. 1-4, and such similar features are identified by similar reference numerals in FIGS. 10-11A using the "3xx" series of reference numerals. Accordingly, certain features of the head 302 of FIGS. 10-11A that are already described above may described below using less detail, or may not be described at all.

In the embodiment of FIGS. 10-11A, the face 312 has an insert 340 that is generally centered on the face 312 and is located around the area of highest response 327 of the face 312. The insert 340 extends completely through the face 312 in this embodiment, and makes up a portion of the ball striking surface 310 and the inner surface 311 of the face 312, as shown in FIGS. 10-11A. The insert 340 may be connected to the face 312 by an integral joining technique, or another connection technique. In general, the insert 340 may be sized to make up any portion of the face 312. Additionally, the insert 340 in this embodiment has a multi-layered structure with a plurality of layers 330, where at least one of the layers 330 has a modulus that is different than at least one of the other layers 330, creating a modulus gradient as described above. The insert 340 shown in FIG. 11A has four layers 330, but as similarly described above, the insert 340 may have a different number of layers 330, or may be a non-layered structure, in other embodiments. Any of the multi-layer structures and resulting modulus gradients described elsewhere herein may be used in connection with the head 302, face 312, and insert 340 of FIGS. 10-11A, in various embodiments.

Figure 12:
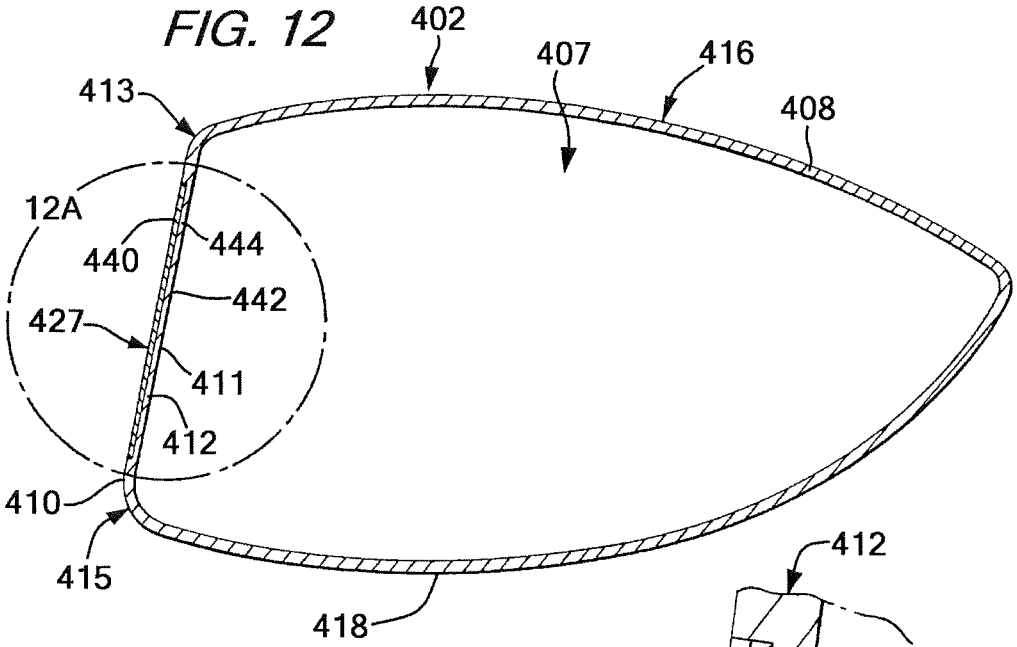
FIG. 12 is a cross-section view of another illustrative embodiment of a wood-type golf club head according to aspects of the present invention, that may be utilized with the ball striking device of FIG. 1.
Figure 12A:
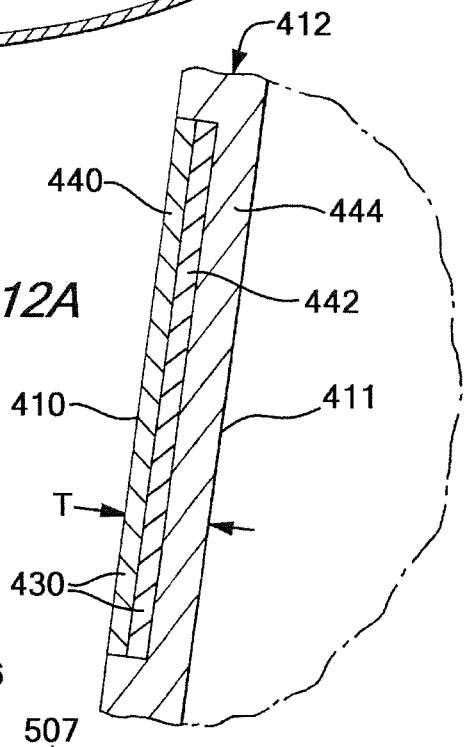
FIG. 12A is a magnified cross-section view of a portion of the head as shown in FIG. 12, identified by marked area 12A in FIG. 12.

FIGS. 12 and 12A illustrate another example of a head 402 with a face 412 that includes an insert 440 that at least partially creates a modulus gradient for the face 412. Many features of the head 402 of FIGS. 12 and 12A are similar to the features of the head 102 shown in FIGS. 1-4, and such similar features are identified by similar reference numerals in FIGS. 12 and 12A using the "4xx" series of reference numerals. Accordingly, certain features of the head 402 of FIGS. 12 and 12A that are already be described above may described below using less detail, or may not be described at all.

In the embodiment of FIGS. 12 and 12A, the face 412 has an insert 440 that is generally centered on the face 412 and is located around the area of highest response 427 of the face 412. The insert 440 is received within a recess 442 on the ball striking surface 410 and extends through a portion of the thickness T of the face 412 in this embodiment, and makes up a portion of the ball striking surface 410, as shown in FIGS. 12 and 12A. The insert 440 may be connected to the face 412 by an integral joining technique, or another connection technique. In general, the insert 440 may be sized to make up any portion of the face 412. Additionally, the insert 440 in this embodiment has a multi-layered structure with a plurality of layers 430, where at least one of the layers 430 has a modulus that is different than at least one of the other layers 430, creating a modulus gradient as described above. The thinned portion 444 of the face 412 located behind the recess 442 forms a part of the multi-layered structure and the modulus gradient of the face 412 as well, and may also have a modulus that is different from at least one of the layers 430 of the insert 440. The insert 440 shown in FIG. 12A has two layers 430, but as similarly described above, the insert 440 may have a different number of layers 430, or may be a non-layered structure, in other embodiments. The thinned portion 444 of the face 412 may also have additional layers in one embodiment, combining with the layers 430 of the insert 440 to form a multi-layered structure. In another embodiment, the insert 440 may be received within a recess 442 on the inner surface 411 of the face 412. Any of the multi-layer structures and resulting modulus gradients described elsewhere herein may be used in connection with the head 402, face 412, and insert 440 of FIGS. 12 and 12A, in various embodiments.

Figure 13:
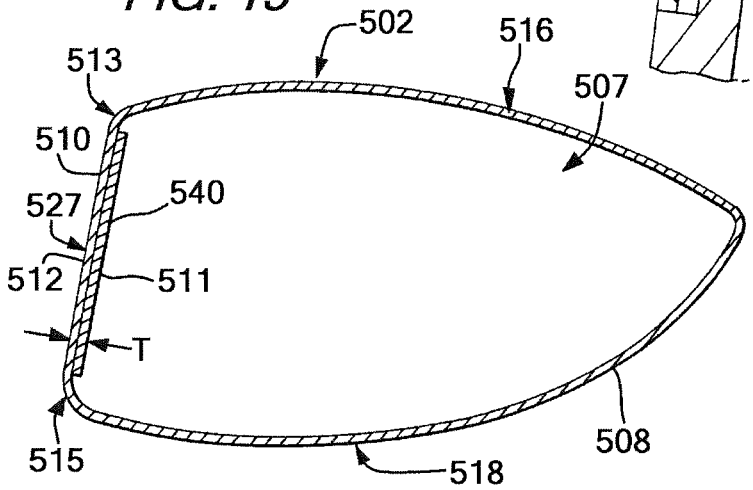
FIG. 13 is a cross-section view of another illustrative embodiment of a wood-type golf club head according to aspects of the present invention, that may be utilized with the ball striking device of FIG. 1.

FIG. 13 illustrates another example of a head 502 with a face 512 that includes an insert 540 that at least partially creates a modulus gradient for the face 512. Many features of the head 502 of FIG. 13 are similar to the features of the head 102 shown in FIGS. 1-4, and such similar features are identified by similar reference numerals in FIG. 13 using the "5xx" series of reference numerals. Accordingly, certain features of the head 502 of FIG. 13 that are already described above may described below using less detail, or may not be described at all.

In the embodiment of FIG. 13, the face 512 has an insert 540 that is generally centered on the face 512 and is covers at least a majority of the inner surface 511 of the face 512, and as shown in FIG. 9, may be considered to occupy substantially the entire inner surface 511. The insert 540 is connected to the inner surface 511 of the face 512 and forms a part of the inner surface 511, and may be connected to the face 512 by an integral joining technique, or another connection technique. In general, the insert 540 may be sized to make up any portion of the face 512. Additionally, the insert 540 in this embodiment may have a single-layered structure or a multi-layered structure, and combines with the adjacent portions of the face 512 to form a multi-layered structure with at least two layers. At least one of these layers has a modulus that is different than at least one of the other layers, creating a modulus gradient as described above. The portions of the face 512 adjacent to the insert 540 may also have additional layers in one embodiment, combining with the insert 540 to form a multi-layered structure. Any of the multi-layer structures and resulting modulus gradients described elsewhere herein may be used in connection with the head 502, face 512, and insert 540 of FIG. 13, in various embodiments. For example, in one embodiment, the ball striking surface 510 of the face 512 may be soft, and the insert 540 may have a higher modulus to provide stiffness to the inner surface 511 of the face 512, as described above. As another example, the ball striking surface 510 may be stiffer, and the insert 540 may have a lower modulus to provide increased flexibility and response, as also described above. The insert 540 may be made of a composite material or a foam material, as mentioned elsewhere herein. Additionally, in one embodiment, the insert 540 may be received in a cavity on the inner surface 511 of the face 512.

Figure 14:
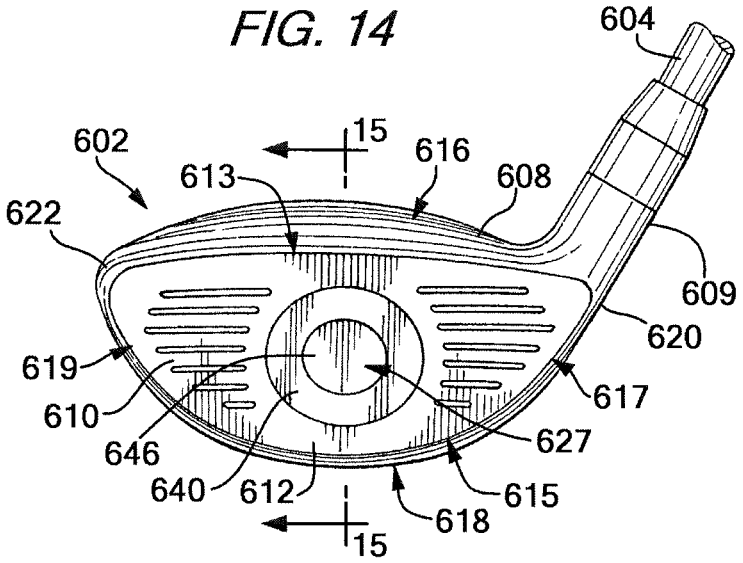
FIG. 14 is a front view of another illustrative embodiment of a wood-type golf club head according to aspects of the present invention, that may be utilized with the ball striking device of FIG. 1.
Figure 15:
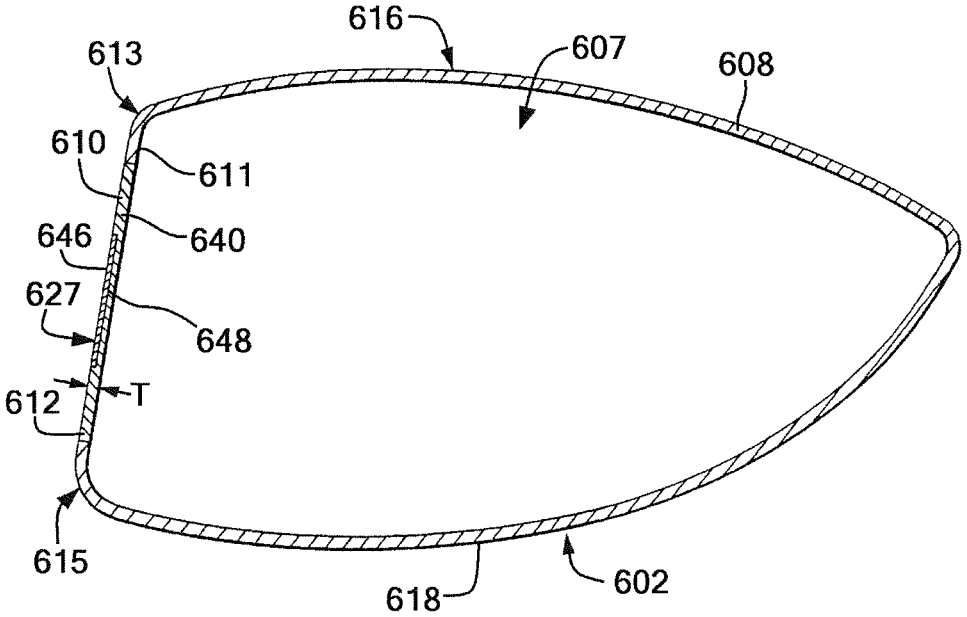
FIG. 15 is a cross-section view of the head of FIG. 14, taken along lines 15-15 of FIG. 14.

FIGS. 14-15 illustrate another example of a head 602 with a face 612 that includes two inserts 640, 646 that at least partially create a modulus gradient for the face 612. Many features of the head 602 of FIGS. 14-15 are similar to the features of the head 102 shown in FIGS. 1-4, and such similar features are identified by similar reference numerals in FIGS. 14-15 using the "6xx" series of reference numerals. Accordingly, certain features of the head 602 of FIGS. 14-15 that are already described above may be described below using less detail, or may not be described at all.

In the embodiment of FIGS. 14-15, the face 612 has an insert 640 that is generally centered on the face 612 and is located around the area of highest response 627 of the face 612. The insert 640 is received within a recess 642 on the ball striking surface 610 and extends completely through the face 612 in this embodiment, and makes up a portion of the ball striking surface 610 and a portion of the inner surface 611, as shown in FIGS. 14-15. The insert 640 may be connected to the face 612 by an integral joining technique, or another connection technique. In general, the insert 640 may be sized to make up any portion of the face 612. Additionally, the insert 640 in this embodiment has a multi-layered structure formed at least partially by a secondary insert 646 received within a recess 648 in the center of the insert 640. Although not shown in FIGS. 14-15, one or both of the insert 640 and the secondary insert 646 may have a multi-layered structure as well. At least one of the collective layers of the insert 640 and the secondary insert 646 has a modulus that is different than at least one of the other such layers, creating a modulus gradient as described above. The modulus gradient in this embodiment may also extend laterally on the face 612, as well as through the thickness T of the face 612, as the secondary insert 646 may create a modulus at the center of the ball striking surface 610 that is different from the modulus at the portions of the ball striking surface 610 formed by the insert 640 or by the face 612 itself. In another embodiment, the insert 640 may be received in a recess in the ball striking surface 610 or the inner surface 611 of the face 612, similarly to the insert 440 of FIGS. 12 and 12A, so that the face 612 also includes a thinned portion that makes up a portion of the modulus gradient. Any of the multi-layer structures and resulting modulus gradients described elsewhere herein may be used in connection with the head 602, face 612, and inserts 640, 646 of FIGS. 14-15, in various embodiments.

It is understood that additional types and configurations of inserts may be used in connection with a face 112 of a golf club head 102 as shown in FIGS. 1-4. For example, any of the inserts 340, 440, 540, 640, 646 of FIGS. 10-15 may have a surface treatment or a different size or shape. Additionally, two or more of the inserts 340, 440, 540, 640, 646 of FIGS. 10-15 may be used in a single embodiment. Still further variations are envisioned.

Figure 21:
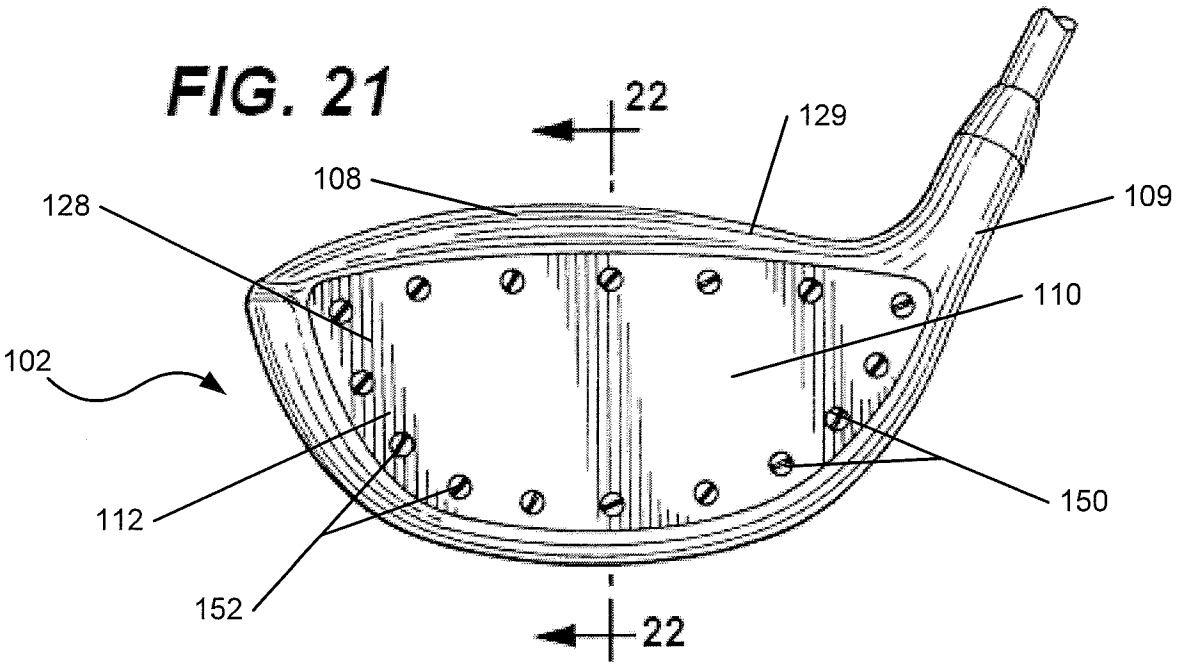
FIG. 21 is a front view of one embodiment of a configuration for connecting a face to a body of the head of FIG. 2, according to aspects of the present invention.
Figure 22:
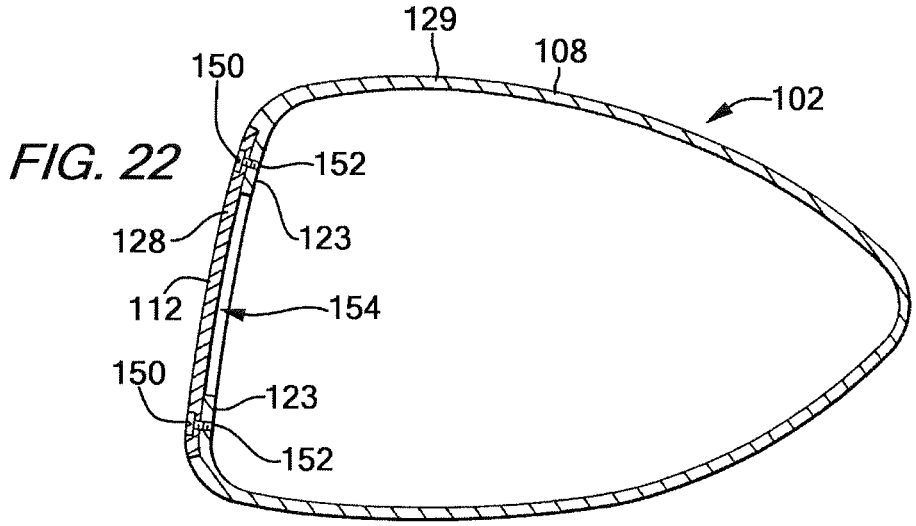
FIG. 22 is a cross-section view of the head of FIG. 21, taken along lines 22-22 of FIG. 21.
Figure 23:
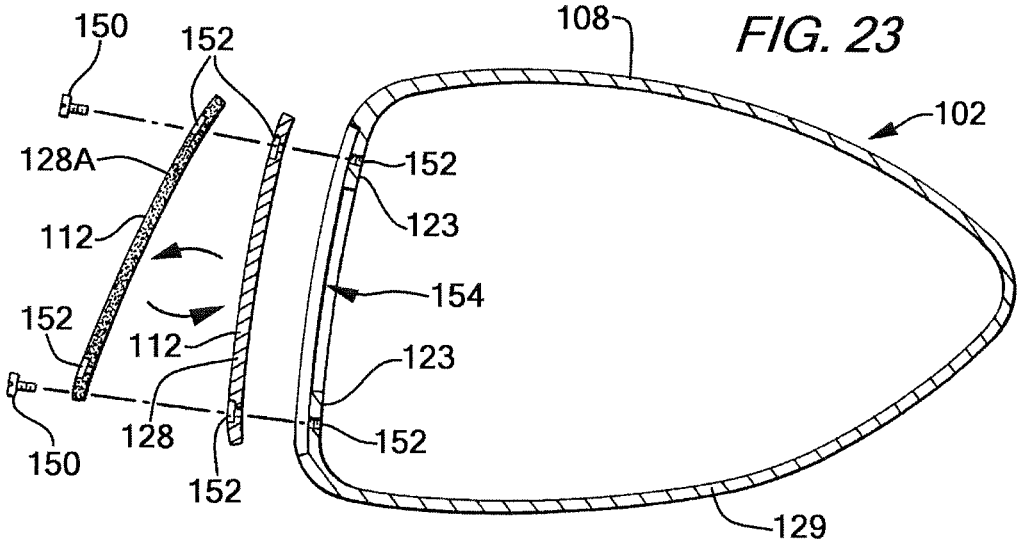
FIG. 23 is a cross-section view of the head of FIG. 21, shown with a face member being interchanged with a second face member.
Figure 24:
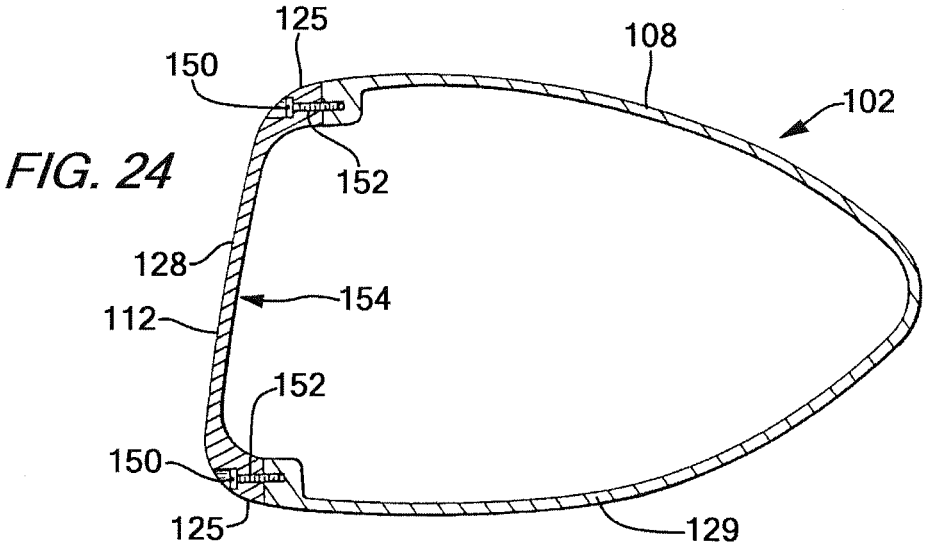
FIG. 24 is a cross-section view of another embodiment of a configuration for connecting a face to a body of the head of FIG. 2, according to aspects of the present invention.

FIGS. 21-28 illustrate various techniques and configurations for connecting the face 112 to the body 108, such as through the use of a face member 128 and a body member 129, either of which may be formed of a single piece or multiple pieces. These embodiments are described herein for use with the head 102 as shown in FIGS. 1-6A, but it is understood that the configurations shown and described can be used in connection with any other embodiment described herein. FIGS. 21-23 illustrate one embodiment where the head 102 is formed of a face member 128 and body member 129 connected to the face member 128. The body member 129 includes an opening 154 that has a lip or flange 123 around the periphery, and the face member 128 is received within the opening 154 and rests against the flange 123. The face member 128 and the flange 123 have holes 152 extending completely or partially therethrough that are configured to receive fasteners 150, such as screws as shown in FIGS. 21-23, to connect the face member 128 to the body member 129. In this configuration, the face member 128 forms the face 112 of the head 102, and the body member 129 forms the entire body 108 of the head 102. In another embodiment, the body member 129 may form a portion of the face 112, and/or the face member 128 may form a portion of the body 108. FIG. 24 illustrates an embodiment where the head 102 is formed of a face member 128 that includes wall(s) 125 extending rearward from the face 112, and a body member 129 connected to the wall(s) 125 and extending rearward from the walls 125. The face member 128 and the body member 129 of FIG. 24 are likewise connected by fasteners 150 extending through holes in the face member 128 and the body member 129. In other embodiments, other types of fasteners 150 or other connection techniques (e.g. welding, adhesive, etc.) may be used to connect the face and body members 128, 129 shown in FIGS. 21-24.

The embodiments shown in FIGS. 21-24 permit the face 112 to be interchangeable with another face 112 to change the properties of the face 112. For example, as shown in FIG. 23, the face member 128 can be removed from the body member 129 by removing the fasteners 150, and then the face member 128 can be removed and replaced with a replacement face member 128A. The replacement face member 128A may have at least one property (e.g. stiffness) that is different from that of the previous face member 128, to permit the properties of the face 112 to be changed. As one example, the replacement face member 128A may have a different multi-layered structure and/or modulus configuration. The face members 128, 128A may have any configuration of the faces 112, et seq., as shown and described herein.

Figure 25:
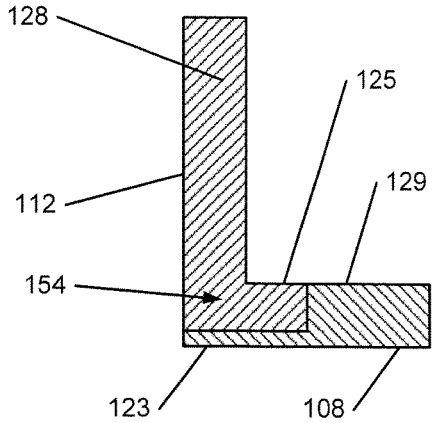
FIG. 25 is a cross-section view of another embodiment of a configuration for connecting a face to a body of the head of FIG. 2, according to aspects of the present invention.
Figure 26:
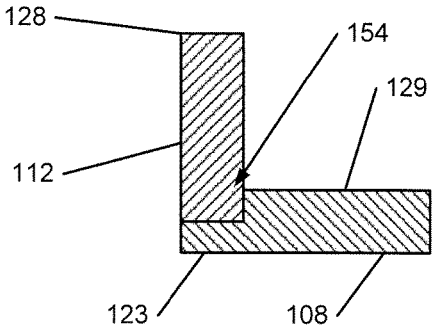
FIG. 26 is a cross-section view of another embodiment of a configuration for connecting a face to a body of the head of FIG. 2, according to aspects of the present invention.
Figure 27:
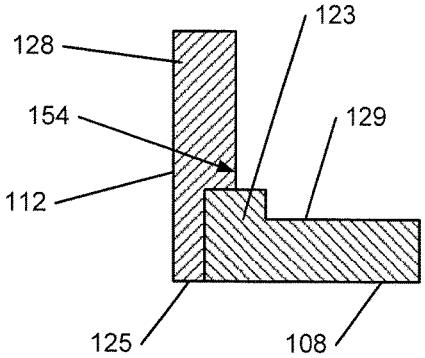
FIG. 27 is a cross-section view of another embodiment of a configuration for connecting a face to a body of the head of FIG. 2, according to aspects of the present invention.
Figure 28:
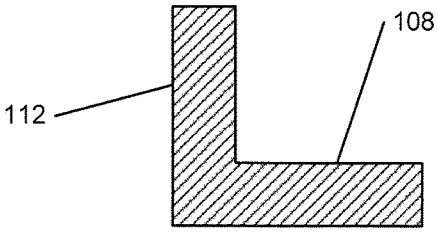
FIG. 28 is a cross-section view of another embodiment of a configuration for connecting a face to a body of the head of FIG. 2, according to aspects of the present invention.

FIGS. 25-28 illustrate other embodiments and configurations for connecting the face 112 to the body 108. FIG. 25 illustrates an embodiment where the face 112 is formed by a cup-shaped face member 128, having walls 125 extending rearward from the face 125, and the body 108 is formed by a body member 129 that is connected to the face member 128. In this embodiment, the face member 128 is received in an opening 154 in the body member 129, and the body member 129 has a flange 123 that extends along the edges of the face member 128. FIG. 26 illustrates an embodiment where the face 112 is formed by a plate-like face member 128 that is received in an opening 154 of the body member 129, and the body member 129 has a flange 123 that extends along the edges of the face member 128. FIG. 27 illustrates an embodiment where the face 112 is formed by a plate-like face member 128 that is partially received in an opening 154 in the body member 129. The body member 129 has flanges 123 that extend into the opening 154 and abut flanges 125 extending from the outer edges of the face member 128. In the embodiments of FIGS. 25-27, the face member 128 and the body member 129 may be connected using any of the connection techniques described herein, including welding, bonding materials (e.g. adhesives such as epoxy), fasteners, a snap or interference fit, etc. In one embodiment, one or more metallic components of the multi-layer face 112 of the face member 128 may be welded to metallic portions of the body member 129. FIG. 28 illustrates an embodiment where the face 112 and the body 108 are formed of a single piece, such as by integral forming or welding the pieces together to form a single piece. It is understood that any of the connection techniques shown in FIGS. 21-28 may be used in connection with any of the heads 102, 202, 302, 402, 502, 602 in FIGS. 1-15, as well as the heads 702, 802, 902, 1002 described below and shown in FIGS. 16-20. Additionally, connection techniques as shown or described in U.S. Pat. No. 7,871,334, issued Jan. 18, 2011, U.S. Pat. No. 7,878,919, issued Feb. 1, 2011, U.S. patent application Ser. No. 12/533,096, filed Jul. 31, 2009, and/or U.S. patent application Ser. No. 12/790,368, filed May 28, 2010, all of which are incorporated by reference herein in their entireties and made parts hereof.

The stiffness and other properties of the connection interface between the body 108 and the face 112 may further affect the properties of the face 112, such as the stiffness and response of the face 112. For example, interfaces that have greater stiffness and/or reinforcement may result in a stiffer face 112, and interfaces with less reinforcement may result in a more flexible face. Further, the amount of tightness or preload on the fasteners 150 as shown in FIGS. 21-24, or the arrangement of the fasteners 150, may also affect the stiffness and/or response of the face 112. Accordingly, in one embodiment, a connection configuration may be selected in order to influence the stiffness and/or response of the face 112 in a desired manner.

Figure 16:
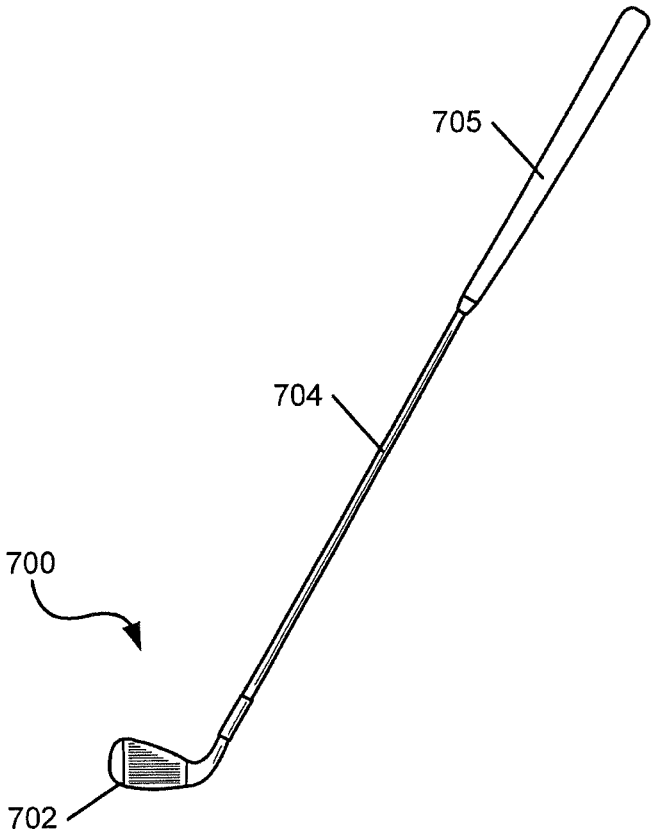
FIG. 16 is a front view of an illustrative embodiment of an iron-type ball striking device according to aspects of the present invention.
Figure 17:
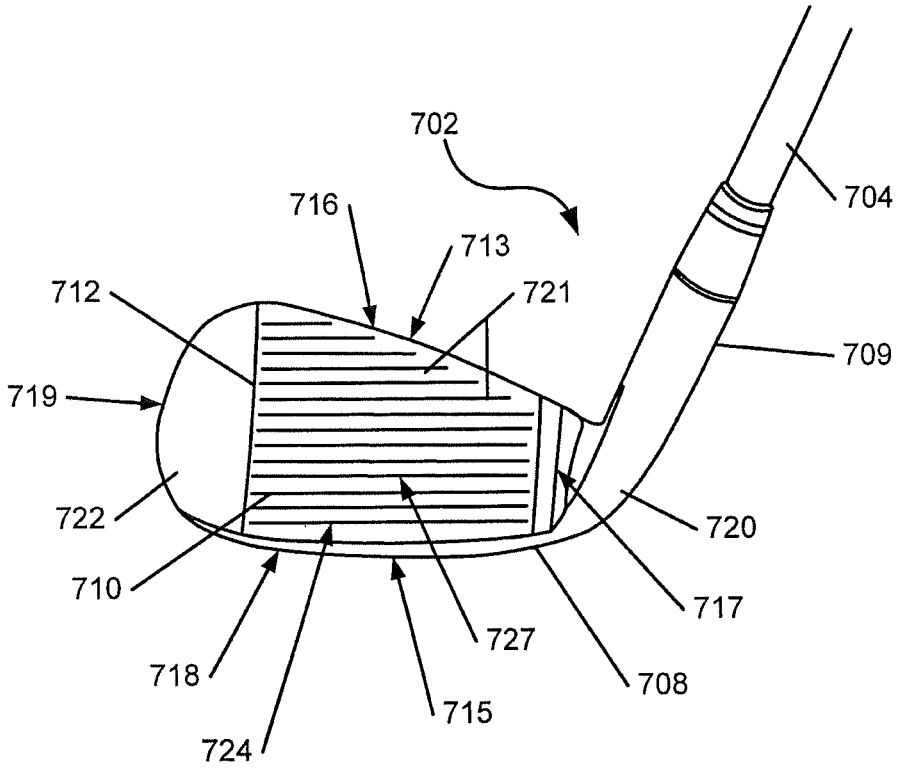
FIG. 17 is a front view of a head of the iron-type ball striking device of FIG. 16.

FIGS. 16-17 illustrate a ball striking device 700 in the form of a golf iron, in accordance with at least some examples of this invention. Many common components between the ball striking device 100 of FIGS. 1-4 and the ball striking device 700 of FIGS. 16-17 are referred to using similar reference numerals in the description that follows, using the "7xx" series of reference numerals. The ball striking device 700 includes a shaft 704 and a golf club head 702 attached to the shaft 704. The golf club head 702 of FIG.

17 may be representative of any iron or hybrid type golf club head in accordance with examples of the present invention.

As shown in FIGS. 16-17, the golf club head 702 includes a body member 708 having a face 712 and a hosel 709 extending from the body 708 for attachment of the shaft 704. For reference, the head 702 generally has a top 716, a bottom or sole 718, a heel 720 proximate the hosel 709, a toe 722 distal from the hosel 709, a front 724, and a back or rear (not shown). The shape and design of the head 702 may be partially dictated by the intended use of the device 700. The heel portion 720 is attached to and/or extends from a hosel 709 (e.g., as a unitary or integral one piece construction, as separate connected elements, etc.).

The face 712 is located at the front 724 of the head 702, and has an outer surface 710, as well as a rear surface (not shown, see 811, 911, 1011 in FIGS. 18-20) located opposite the outer surface 710, which may be considered an inner surface of the face 712. The face 712 is defined by a plurality of peripheral edges, including a top edge 713, a bottom edge 715, a heel edge 717, and a toe edge 719. The face 712 also has a plurality of face grooves 721 on the ball striking surface 710. For reference purposes, the portion of the face 712 nearest the top face edge 713 and the heel 720 of the head 702 is referred to as the "high-heel area"; the portion of the face 712 nearest the top face edge 713 and toe 722 of the head 702 is referred to as the "high-toe area"; the portion of the face 712 nearest the bottom face edge 715 and heel 720 of the head 702 is referred to as the "low-heel area"; and the portion of the face 712 nearest the bottom face edge 715 and toe 722 of the head 702 is referred to as the "low-toe area". Conceptually, these areas may be recognized and referred to as quadrants of substantially equal size (and/or quadrants extending from a geometric center of the face 712), though not necessarily with symmetrical dimensions. The face 712 may include some curvature in the top to bottom and/or heel to toe directions (e.g., bulge and roll characteristics), as is known and is conventional in the art. The ball striking surface 710 is inclined (i.e., at a loft angle), to give the ball an appreciable degree of lift and spin when struck. In various embodiments, the ball striking surface 710 may have a different incline or loft angle, to affect the trajectory of the ball.

The body member 708 of the golf club head 702 may be constructed from a wide variety of different materials, including materials conventionally known and used in the art, such as steel, titanium, aluminum, tungsten, graphite, elastomers or other polymers, or composites, or combinations thereof. Also, if desired, the club head 702 may be made from any number of pieces (e.g., having a separate face plate, etc.) and/or by any construction technique, including, for example, casting, forging, welding, and/or other methods known and used in the art. The face 712 may be constructed using any of the materials described above, to create a face 712 where at least a portion thereof has a modulus gradient.

The ball striking device 700 may include a shaft 704 connected to or otherwise engaged with the ball striking head 702, as shown in FIG. 16 and described above. The shaft 704 is adapted to be gripped by a user to swing the ball striking device 700 to strike the ball. The shaft 704 can be formed as a separate piece connected to the head 702, such as by connecting to the hosel 709, as shown in FIG. 16. Any desired hosel and/or head/shaft interconnection structure may be used without departing from this invention, including those described above.

Figure 18:
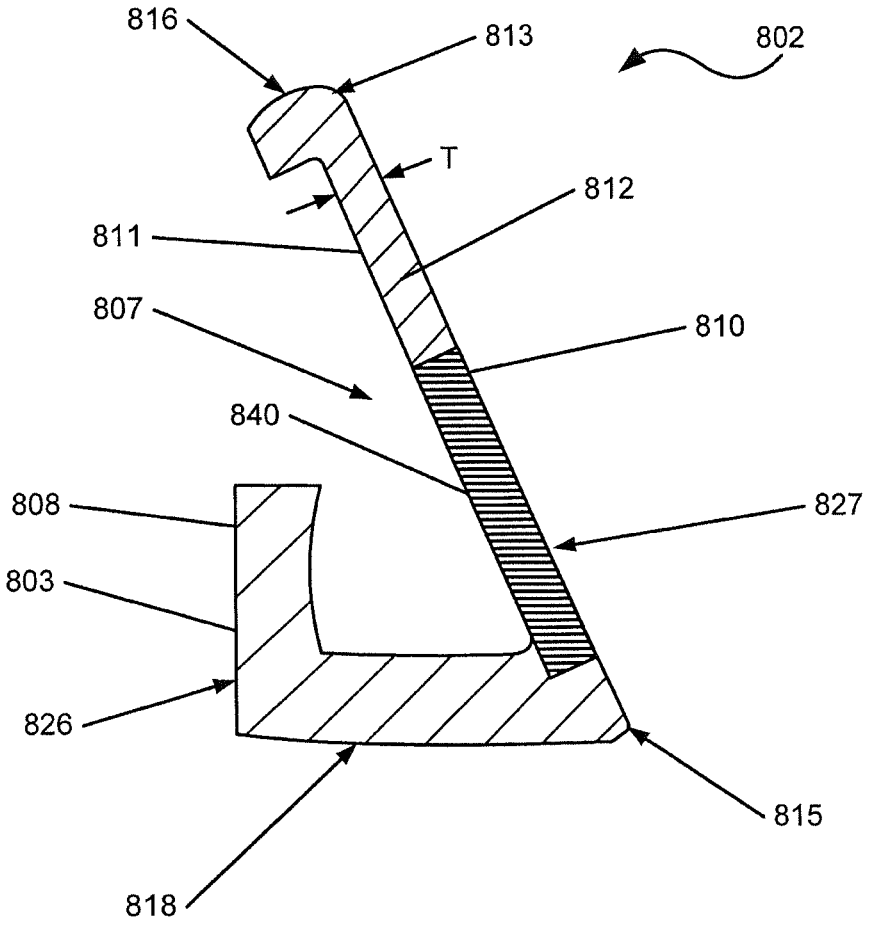
FIG. 18 is a cross-section view of another embodiment of an iron-type golf club head, that may be utilized with the ball striking device of FIG. 16.
Figure 19:
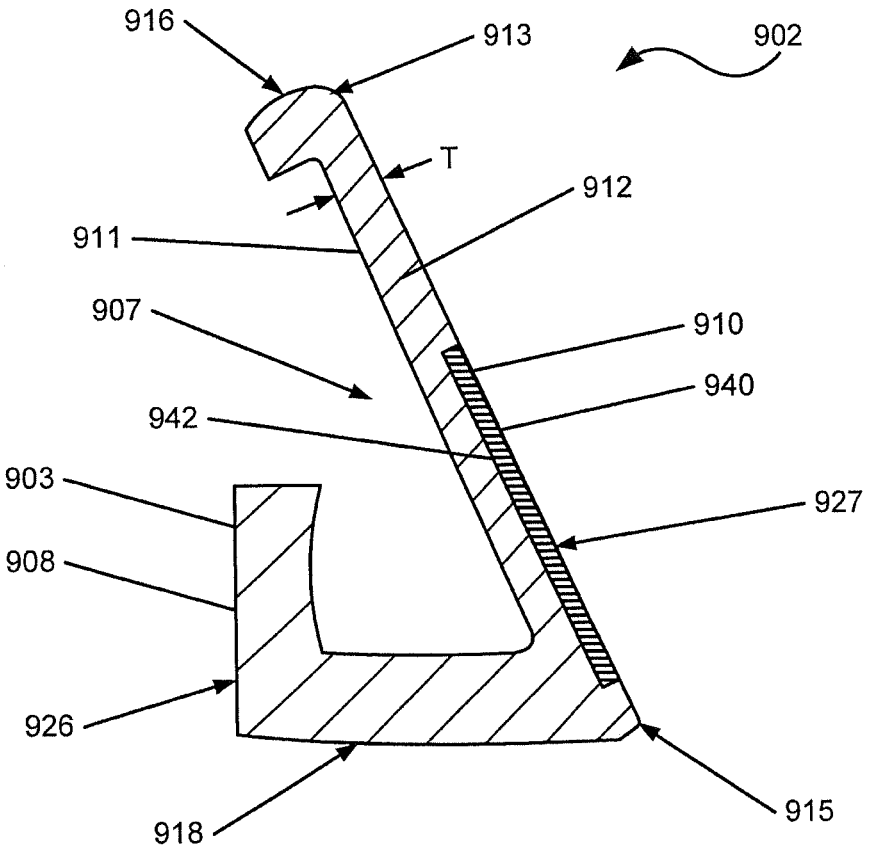
FIG. 19 is a cross-section view of another embodiment of an iron-type golf club head, that may be utilized with the ball striking device of FIG. 16.
Figure 20:
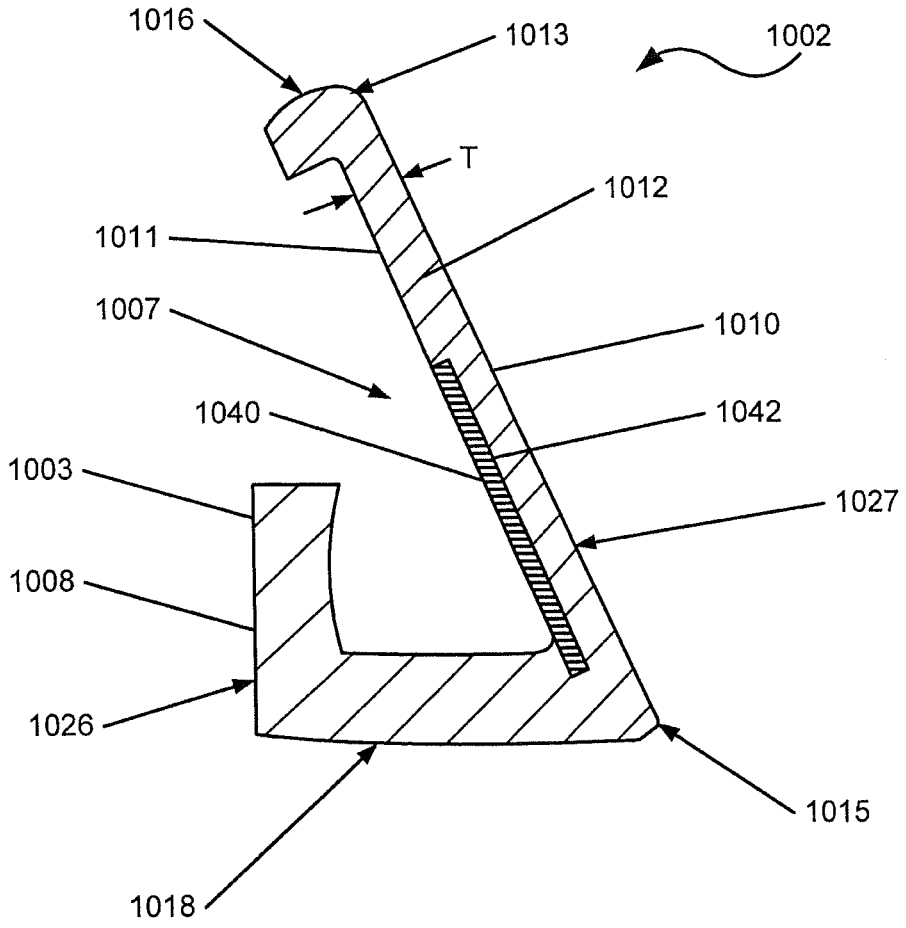
FIG. 20 is a cross-section view of another embodiment of an iron-type golf club head, that may be utilized with the ball striking device of FIG. 16.

In general, FIGS. 16-17 illustrate a head 702 that has a face 712 that has at least a portion with a modulus gradient through the thickness of the face 712, as described above. Such a modulus gradient can be accomplished by the use of a composite material, an insert, a multi-layered structure, a surface treatment, or any other configuration described above, including combinations of such configurations. FIGS. 18-20 illustrate several embodiments representing such potential configurations for creating a modulus gradient in an iron-type head 702 as shown in FIGS. 16-17.

FIG. 18 illustrates an embodiment of a head 802 that includes an insert 840 that is similar to the insert 340 of FIGS. 10-11A connected to the face 812 thereof. Many features of the head 802 of FIG. 18 are similar to the features of the heads 102, et seq. shown in FIGS. 1-17, and such similar features are identified by similar reference numerals in FIG. 18 using the "8xx" series of reference numerals. Accordingly, certain features of the head 802 of FIG. 18 that are already described above may described below using less detail, or may not be described at all. FIG. 18 illustrates an iron-type golf club head 802 that includes a rear cavity 807 behind the face 812, and a rear wall 803 extending upward from the sole portion of the body 808 at the rear 826 of the head 802. The rear cavity 807 is defined at least partially by the inner surface 811 of the face 812, the sole portion of the body 808, and the rear wall 803. In other embodiments, the features of the head 802 of FIG. 18 can be utilized with other iron-type club heads, including other cavity-back designs, half-cavity or partial-cavity designs, blade-type iron designs with no rear cavity, etc.

In the embodiment of FIG. 18, the insert 840 extends completely through the thickness T of the face 812 and forms a portion of the ball striking surface 810 and the inner surface 811 of the face 812, similar to the insert 340 in FIGS. 10-11A. The insert 840 may be connected to the face 812 by an integral joining technique, or another connection technique. As described above, the insert 840 may be sized to make up any portion of the face 812, and may be located around the area of highest response 827 of the face 812, or may be positioned elsewhere in other embodiments. Additionally, the insert 840 may have any desired shape, as described above. Further, as also described above, the insert 840 may have a modulus gradient and/or may contribute to the modulus gradient of the face 812. For example, the insert 840 may be formed of a composite material and/or a multi-layered structure, and may have a surface treatment on one or more surfaces thereof, in order to create the modulus gradient. The head 802 of FIG. 18 may include any additional features or variations described above with respect to other embodiments, and the insert 840 may use any other structure described herein for creating the modulus gradient.

FIG. 19 illustrates an embodiment of a head 902 that includes an insert 940 that is similar to the insert 440 of FIGS. 12 and 12A connected to the face 912 thereof. Many features of the head 902 of FIG. 19 are similar to the features of the heads 102, et seq. shown in FIGS. 1-18, and such similar features are identified by similar reference numerals in FIG. 19 using the "9xx" series of reference numerals. Accordingly, certain features of the head 902 of FIG. 19 that are already described above may described below using less detail, or may not be described at all. FIG. 19 illustrates an iron-type golf club head 902 that includes a rear cavity 907 behind the face 912, and a rear wall 903 extending upward from the sole portion of the body 908 at the rear 926 of the head 902. The rear cavity 907 is defined at least partially by the inner surface 911 of the face 912, the sole portion of the body 908, and the rear wall 903. In other embodiments, the features of the head 902 of FIG. 19 can be utilized with other iron-type club heads, including other cavity-back designs, half-cavity or partial-cavity designs, blade-type iron designs with no rear cavity, etc.

In the embodiment of FIG. 19, the insert 940 is received within a recess 942 on the ball striking surface 910 and extends through a portion of the thickness T of the face 912, and makes up a portion of the ball striking surface 910, as shown in FIG. 19. The insert 940 may be connected to the face 912 by an integral joining technique, or another connection technique. As described above, the insert 940 may be sized to make up any portion of the face 912, and may be located around the area of highest response 927 of the face 912, or may be positioned elsewhere in other embodiments. As also described above, the insert 940 may have a modulus gradient and/or may contribute to the modulus gradient of the face 912. For example, the insert 940 may be formed of a composite material and/or a multi-layered structure, and may have a surface treatment on one or more surfaces thereof, in order to create the modulus gradient. The thinned portion 944 of the face 912 located behind the recess 942 forms a part of a multi-layered structure and the modulus gradient of the face 912 along with the insert 940. The thinned portion 944 may also have a modulus that is different from at least a portion of the insert 940, such as a layer of the insert 940, if the insert 940 has a multi-layered structure. The head 902 of FIG. 19 may include any additional features or variations described above with respect to other embodiments, and the insert 940 may use any other structure described herein for creating the modulus gradient.

FIG. 20 illustrates an embodiment of a head 1002 that includes an insert 1040 that is similar to the insert 440 of FIGS. 12 and 12A connected to the face 1012 thereof. Many features of the head 1002 of FIG. 20 are similar to the features of the heads 102, et seq. shown in FIGS. 1-19, and such similar features are identified by similar reference numerals in FIG. 20 using the "10xx" series of reference numerals. Accordingly, certain features of the head 1002 of FIG. 20 that are already described above may described below using less detail, or may not be described at all. FIG. 20 illustrates an iron-type golf club head 1002 that includes a rear cavity 1007 behind the face 1012, and a rear wall 1003 extending upward from the sole portion of the body 1008 at the rear 1026 of the head 1002. The rear cavity 1007 is defined at least partially by the inner surface 1011 of the face 1012, the sole portion of the body 1008, and the rear wall 1003. In other embodiments, the features of the head 1002 of FIG. 20 can be utilized with other iron-type club heads, including other cavity-back designs, half-cavity or partial-cavity designs, blade-type iron designs with no rear cavity, etc.

In the embodiment of FIG. 20, the insert 1040 is received within a recess 1042 on the inner surface 1011 and extends through a portion of the thickness T of the face 1012, and makes up a portion of the inner surface 1011, as shown in FIG. 20. The insert 1040 may be connected to the face 1012 by an integral joining technique, or another connection technique. As described above, the insert 1040 may be sized to make up any portion of the face 1012, and may be located around the area of highest response 1027 of the face 1012, or may be positioned elsewhere in other embodiments. As also described above, the insert 1040 may have a modulus gradient and/or may contribute to the modulus gradient of the face 1012. For example, the insert 1040 may be formed of a composite material and/or a multi-layered structure, and may have a surface treatment on one or more surfaces thereof, in order to create the modulus gradient. The thinned portion 1044 of the face 1012 located in front of the recess 1042 forms a part of a multi-layered structure and the modulus gradient of the face 1012 along with the insert 1040. The thinned portion 1044 may also have a modulus that is different from at least a portion of the insert 1040, such as a layer of the insert 1040, if the insert 1040 has a multi-layered structure. The head 1002 of FIG. 20 may include any additional features or variations described above with respect to other embodiments, and the insert 1040 may use any other structure described herein for creating the modulus gradient.

Several different embodiments have been described above, including the various embodiments of golf clubs 100, 700 and heads 102, 112', 202A-C, 302, 402, 502, 602, 702, 802, 902, 1002 (referred to herein as 102, et seq.) and portions thereof described herein. It is understood that any of the features of these various embodiments may be combined and/or interchanged. For example, as described above, various different combinations of club heads 102, et seq. with differently configured face materials, including different inserts and/or surface treatments, may be used, including the configurations described herein, variations or combinations of such configurations, or other configurations. In further embodiments, at least some of the features described herein can be used in connection with other configurations of iron-type clubs, wood-type clubs, other golf clubs, or other types of ball-striking devices.

Heads 102, et seq. incorporating the features disclosed herein may be used as a ball striking device or a part thereof. For example, a golf club 100 as shown in FIG. 1 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. In one embodiment, a set of golf clubs can be manufactured, where at least one of the clubs has a head with a face that has a modulus gradient through the thickness of the face, as described above.

Additionally, as described above, the head 102, et seq., golf club 100, et seq., or other ball striking device may be fitted or customized for a person by selecting a material or combination of materials that have an appropriate thermal modulus response based on the typical swing speed of a particular golfer. Additionally, the size, shape, and location of any face inserts 230, et seq., utilized herein may be adjusted based on a common hitting pattern of a golfer. Further, inserts may be interchanged or replaced based on customization to a particular golfer or customization to specific play conditions. Still other options for customization are possible.

The ball striking devices and heads therefor as described herein provide many benefits and advantages over existing products. For example, the modulus gradient of the face can be adjusted to provide superior response and/or contact time at a particular swing speed or range of speeds. As another example, lateral modulus gradients across the face may provide increased response and/or contact time for impacts at locations other than the area of highest response of the face. Further, modulus gradients may be "tuned" to provide performance response, as well as sensory feedback (e.g. sound, vibration, feel, etc.). Still other benefits and advantages are readily recognizable to those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. An iron-type golf club head, comprising:
a top portion;
a sole portion opposite the top portion;
a heel portion;
a toe portion opposite the heel portion;
a front portion including a ball striking surface and an inner surface opposite the ball striking surface;
an insert that is integral to the front portion;
a rear cavity opposite the front portion;
wherein the insert comprises a plurality of layers that extends from a portion of the ball striking surface to a portion of the inner surface, such that each layer thereof comprises a different modulus,
wherein the plurality of layers include a first layer, a second layer, a third layer, and a fourth layer, and
wherein the first layer has the highest modulus followed by the second layer, the third layer, and the fourth layer.

2. The iron-type golf club head of claim 1, wherein the insert has a lower modulus than the ball striking surface.

3. The iron-type golf club head of claim 1, wherein the insert has a higher modulus than the ball striking surface.

4. The iron-type golf club head of claim 1, wherein the insert further comprises a surface treatment.

5. The iron-type golf club head of claim 4, wherein the surface treatment can be applied to one or more layer of the insert.

6. The iron-type golf club head of claim 5, wherein the surface treatment is applied to the inner surface of the front portion.

7. The iron-type golf club head of claim 5, wherein the surface treatment is applied to the ball-striking surface.

8. The iron-type golf club head of claim 1, wherein the insert is positioned proximal to the highest response area of the ball striking surface.

9. The iron-type golf club head of claim 1, wherein the second layer of the plurality of layers is a composite material.

10. An iron-type golf club head, comprising:
a top portion;
a sole portion opposite the top portion;
a heel portion;
a toe portion opposite the heel portion;
a front portion including a ball striking surface and an inner surface opposite the ball striking surface;
an insert;
a rear cavity opposite the front portion;
wherein:
the inner surface of the front portion includes a recess that extends from the inner surface towards a portion of the ball striking surface of the front portion;
the insert is received within the recess and includes a plurality of layers, wherein each layer of the plurality of layers comprises a different modulus;
the plurality of layers includes a first layer, a second layer, and a third layer.

11. The iron-type golf club head of claim 10, wherein the insert further comprises a surface treatment.

12. The iron-type golf club head of claim 11, wherein the surface treatment is applied to the ball-striking surface.

13. The iron-type golf club head of claim 10, wherein the plurality of layers includes a fourth layer.

14. The iron-type golf club head of claim 13, wherein the first layer has the highest modulus followed by the second layer, the third layer, and the fourth layer.

15. An iron-type golf club head, comprising:
a top portion;
a sole portion opposite the top portion;
a heel portion;
a toe portion opposite the heel portion;
a front portion including a ball striking surface, an insert, an inner surface opposite the ball striking surface;
a rear cavity opposite the front portion;
wherein:
the ball striking surface of the front portion includes a recess that extends from the ball striking surface towards a portion of the inner surface of the front portion;
the insert is received within the recess and includes a plurality of layers, wherein each layer of the plurality of layers comprises a different modulus;
the insert further includes a surface treatment;
each layer of the plurality of layers has a different surface treatment to further increase a modulus gradient of the iron-type golf club head.

16. The iron-type golf club of claim 15, wherein the surface treatment includes at least one technique selected from a group consisting of: carburizing or other case hardening technique, plasma etching, peening, electron-beam surface treatment, laser surface hardening, flame hardening, induction hardening, diffusion hardening, nitriding, quenching, precipitation strengthening, surface oxygen diffusion permeation, or coating.

* * * * *